US006716808B1

(12) United States Patent
Rohrbaugh et al.

(10) Patent No.: US 6,716,808 B1
(45) Date of Patent: Apr. 6, 2004

(54) DETERGENT COMPOSITIONS COMPRISING HYBRID ZEOLITE BUILDERS CONTAINING AN OCCLUDED NONSILICATE

(75) Inventors: Robert Henry Rohrbaugh, Hamilton, OH (US); Eugene Joseph Pancheri, Cincinnati, OH (US); James Charles Theophile Roger St. Laurent, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/889,635

(22) PCT Filed: Jan. 14, 2000

(86) PCT No.: PCT/US00/00922

§ 371 (c)(1),
(2), (4) Date: Jul. 19, 2001

(87) PCT Pub. No.: WO00/43482

PCT Pub. Date: Jul. 27, 2000

Related U.S. Application Data

(60) Provisional application No. 60/116,644, filed on Jan. 21, 1999.

(51) Int. Cl.[7] ..... C11D 3/08

(52) U.S. Cl. ..... 510/507; 510/315; 510/323; 510/377; 423/700

(58) Field of Search ..... 510/315, 323, 510/377, 507; 423/700

(56) References Cited

U.S. PATENT DOCUMENTS

| | | | | |
|---|---|---|---|---|
| 4,178,354 A | | 12/1979 | Murata et al. | |
| 5,942,207 A | * | 8/1999 | Moini et al. | 423/700 |
| 5,948,383 A | * | 9/1999 | Kuznicki et al. | 423/700 |

FOREIGN PATENT DOCUMENTS

| | | |
|---|---|---|
| WO | 98/42622 | * 10/1998 |

* cited by examiner

*Primary Examiner*—Charles Boyer
(74) *Attorney, Agent, or Firm*—Marianne Dressman; Julia A. Glazer; Brahm J. Corstanje

(57) ABSTRACT

Built laundry detergent compositions, especially granules, powders, tablets or syndet bars for domestic use, wherein the builder comprises at least in part a hybrid crystalline aluminosilicate having occluded silicate, carbonate, sulfate, phosphate, borate, nitrate, nitrite, $Na_2O$, or mixtures thereof; and wherein the hybrid can further be chemically or physically surface-modified, combined with other builders, or processed in particular ways; and wherein the hybrid is coformulated with detergent adjuncts selected to improve the compositions, especially certain surfactants, particularly mid-chain branched types; certain bleach systems, especially those having bleach catalysts; and certain enzymes or other adjuncts.

4 Claims, No Drawings

DETERGENT COMPOSITIONS COMPRISING HYBRID ZEOLITE BUILDERS CONTAINING AN OCCLUDED NONSILICATE

This application claims the benefit of provisional application 60/116,644 filed Jan. 21, 1999.

TECHNICAL FIELD

This invention relates to built detergents for domestic use, especially having granular, tablet or syndet bar form. The compositions contain particular aluminosilicate builders, preferably hybrids of aluminosilicate and specific occluded materials such as silicate, carbonate, sulfate, phosphate, borate, nitrate, nitrite, $Na_2O$, or mixtures thereof. The builder can be surface-modified or can be processed in a particular manner. The compositions further contain selected detergent adjuncts, such as certain surfactants, enzymes, polymers and/or bleaches. Other adjuncts, e.g., conventional surfactants, enzymes, builders or bleaches can also be present.

BACKGROUND OF THE INVENTION

The formulation of zeolite builders into detergents is technically difficult. Zeolites hitherto formulated in detergents lack an ideal combination of low cost, ease of manufacture, high equilibrium binding of both Ca and Mg, rapid kinetics of binding for Ca and Mg, and ability to hold large amounts of surfactant. Zeolites or aluminosilicates, when added to laundry detergents, can interact adversely with numerous laundry detergent adjuncts, e.g. bleaches, bleach catalysts, enzymes, brighteners and other additives, and/or produce unacceptable harshness and/or give other major problems, such as redeposition onto textiles.

Another significant technical problem is a strong tendency for low-level adjuncts or differently charged additives such as cationic surfactants, catalysts or enzymes to adsorb onto relatively large, anionically charged surfaces of insoluble inorganic builders. Since such adjuncts are often expensive and tend to be used at relatively low levels in detergent compositions, their loss by any mechanism, such as interaction with the builder, can have dramatic effects on overall cleaning performance.

Accordingly, substantial and costly research and experimentation are needed to integrate a synthetic inorganic builder material with other detergent ingredients so as to benefit from its properties and at the same time avoid negating or reducing the desirable effect(s) of the adjuncts with which it is formulated. Such experimentation often results in failure. There is, therefore, an ongoing unmet need for fully formulated detergent compositions acceptably, incorporating synthetic inorganic builders, especially certain types for which synthesis methods have only recently been described.

BACKGROUND ART

WO 98/42622, to Englehard Corporation, published Oct. 1, 1998, provides processes for preparing certain hybrid zeolite-silicate compositions. These materials do not contain hydroxysodalite, indeed a comparison is given to demonstrate the absence thereof. Also described are some detergent formulations using, the hybrid aluminosilicates. Solving the problems of formulating these hybrid builders, especially with certain potentially interacting low-level, high cost ingredients, are not, however specifically addressed. It appears to be assumed that the hybrid zeolite-silicate can simply be formulated as a replacement for current zeolites, and the formulation teaching is to conventional zeolite detergents. However, according to the theory of operation described in WO 98/42622, the hybrid material has a higher charge. Whether for this reason or due to some other theory of operation, it has now been discovered that the WO 98/42622 hybrid materials do not have the same properties for purposes of formulation into detergents as do the conventional detergent zeolite, zeolite A.

While WO 98/42622 provides apparently useful synthesis methods, and the evidence provided in WO 98/42622 strongly suggests that the WO 98/42622 hybrid material is different from zeolite MAP, whether this hybrid or silicate-occluded material is in fact novel may, or may not, be the case. There exists a substantial body of old prior art on zeolite manufacture which is not in computer-readable form and as such is relatively difficult to find and/or search. An accessible fraction of this art includes disclosure of occluded, or hybrid-type (to use the WO 98/42622 language) zeolites or hybrid aluminosilicates having occluded salts of various kinds, and hints that occlusion is well-known to zeolite manufacturers. For example, occluded zeolites are described in "Zeolite Chemistry and Catalysts". Ed. J. A. Rabo, ACS Monograph Series. Vol. 171, American Chemical Society, Washington D.C. 1976. See more particularly Chapter 5. "Salt Occlusion in Zeolite Crystals", pages 33–349 and references cited therein, see also Chapter 1 of the same reference. Thus, such materials include, for example, sodium nitrate-occluded or other nitrate salt-occluded zeolite A, see the work referenced by Liquomik and Marcus. See also Chapter 1, pages 58–63 of the same ACS monograph, which discloses, for example, $NaAlO_2$ occluded zeolite A; other occluded aluminosilicates, such as borate-occluded sodalite, NaOH-occluded sodalite, $Na_2CO_3$-occluded cancrinite, halide- or nitrate-occluded zeolite Y, and yet other salt-occluded zeolites. In Chapter 4 of the ACS monograph, it is noted "Another consequence of the Donnan equilibrium is that electrolyte invasion can occur. In this process, anions from the aqueous phase enter into the zeolite phase with a correspondingly equivalent number of additional cations." See also Chapter 4 of the same ACS monograph at pages 310–111, for example the statement "Modified varieties of many zeolites can be prepared by occluding extraneous species within the zeolite crystal either during or after synthesis." Reference is made to the work of Barrer and others. In Chapter 5 at page 338, reference is made to borate-occluded zeolite A. In short, a wealth of occluded aluminosilicate materials appear to be disclosed in the art.

Surprisingly, in contrast, other than in WO 98/42622, there appears to be no specific disclosure whatever of the use of occluded or hybrid-type zeolites or other occluded aluminosilicates in detergent compositions.

It is therefore against a background of (a) an apparent plurality of occlusions in zeolites coupled with (b) a lack of teaching on how to formulate occluded or hybrid-type aluminosilicate materials in detergents other than as a mere substitute for zeolite A or P as taught in WO 98/42622, that the present invention is provided.

Additionally by way of background on zeolites and occluded zeolites, the practitioner is referred to D. W. Breck, "Zeolite Molecular Sieves", Wiley, New York. 1974 and to Kirk Othmer's Encycopedia of Chemical Technology, 4th Edition, 1995, Wiley, New York, see Vol. 16, "Molecular Sieves".

Builders in general are described in many patents issued to Procter & Gamble, Unilever, Hoechst/Clariant, Kao, Lion, Crosfield, PQ Corp., and others. One recent review in the context of detergents is in Surfactant Science Series, Marcel Dekker, New York, see Vol. 71, Ed. M. S. Showell, published 1998. See more particularly Chapter 3, "Builders: The Backbone of Powdered Detergents" by Hans-Peter Rieck of Hoechst/Clariant.

All percentages herein are by weight of the detergent composition unless otherwise noted. All references cited are incorporated by reference in their entirety,. Ratios and proportions are by weight unless otherwise specifically indicated.

SUMMARY OF THE INVENTION

In a first aspect or embodiment of the invention, it has now been discovered that improved detergent compositions beyond those described in WO 98/42622 can be formulated by combining the hybrid zeolite-silicates of WO98/42622 with particular detergent ingredients.

In a second aspect or embodiment of the invention, improved detergent compositions are formed by combining detergent ingredients with certain hybrid zeolite-cobuilders not specifically described in WO98/42622. In these materials, the hybrid builder has an occluded material other than silicate, such as sulfate, borate, nitrate, nitrite, phosphate, or $Na_2O$.

In a third aspect or embodiment of the invention, improved detergent compositions are formed by combining detergent ingredients with combinations of hybrid zeolite-silicate and hybrid zeolite-cobuilder systems wherein these combinations are not described in WO98/42622. In these systems, the hybrid builder has both occluded silicate and another occluded material other than silicate, especially an anion having charge greater than 1, such as occluded sulfate, occluded borate, occluded phosphate, though occluded nitrate, occluded nitrite, or mixtures of any of the aforementioned cobuilders is possible. In other variations, alkali metal oxides or hydroxides, such as $Na_2O$ or NaOH, are present with excellent results.

In a fourth aspect or embodiment of the invention, improved detergent compositions are formed by combining detergent ingredients with any of said hybrid zeolite-silicate or hybrid zeolite-cobuilder systems, wherein the hybrid zeolite-silicate or hybrid zeolite-cobuilder occluded system is further modified by chemical or physical modification of the external surfaces. Such modification can range quite widely, from a chemical approach, such as surface silylation or treatment with reactive aminosilicones, to a physical approach, such as such as direct contacting of the hybrid with PEG, e.g., PEG 4000, waxy nonionic surfactants, film-forming polymers as defined in detail hereinafter, or combinations of chemical and physical treatment. The surface treatment adjunct can improve one or more aspects of cleaning or fabric care when the treated hybrid is included in a detergent formulation. For example, the treated hybrid when formulated with low-level cationic cosurfactants, enzymes, transition metal bleach catalysts, or the like, can be shown to have a reduced tendency to interfere with the cleaning performance of such desirable adjuncts.

In a fifth aspect or embodiment of the invention, improved detergent compositions are formed by combining detergent ingredients with any of said hybrid materials in the presence of innocuous fillers or common inorganic pigments, including in particular nonzeolitic aluminosilicates such as hydroxysodalite and/or talc and/or whiteners such as titanium dioxide. The hydroxysodalite or other filler or whitener or mineral can be present in the hybrid, e.g., through crystal imperfections, can be present in the builder system, or can be introduced along with other detergent adjuncts. While these filled detergent compositions might be expected to be significantly worse for cleaning than the unfilled types of compositions, they are surprisingly effective, for example in laundry bars.

Without being limited by theory, the absolute magnitude of the cation exchange capacity and even the rate of sequestration of builder materials are not the only factors to consider in arriving at excellent detergent compositions. Wetting and dispersion rates, and processing characteristics of the materials, for example, can also be important. Thus, while the introduction of materials such as hydroxysodalite and the aforementioned surface treatments of the hybrid may not add to the technical measurable builder capacity through these other factors, the filler and/or surface treatment material may lead to improved detergent compositions. This is particularly true when problems such as redeposition are properly addressed through coformulation of the hybrid builder with other selected detergent adjuncts.

The present invention, therefore, has numerous advantages, including improved laundry cleaning and/or anti-redeposition performance and/or cost effectiveness as compared with the cleaning and/or antiredeposition performance offered by WO98/42622 alone. Other significant advantages are improved compatibility of the formulated ingredients, for example, a reduced tendency of the hybrid builder to interact negatively with coformulated detergent ingredients.

DETAILED DESCRIPTION—PREFERRED EMBODIMENTS

The present invention includes a detergent composition comprising: (a) from about 0.1% to about 99% of a builder system comprising, in part, a particulate inorganic ion-exchanging builder material, said builder material comprising a hybrid of crystalline zeolitic aluminosilicate and at least one occluded nonsilicate cobuilder; and (b) from about 0.1% to about 99% of detergent adjuncts. Preferably in said embodiment, said hybrid comprises from about 0.01 to 1.0, more preferably 0.10 to 1.0, weight fraction of said builder system and said hybrid is characterized by a capacity to sequester calcium in excess of the amount of charge inducing aluminum in the zeolitic aluminosilicate. Alternately, said hybrid is characterized by a calcium ion exchange capacity of at least 15% greater, preferably at least 20%, more preferably at least 25% greater than the calcium ion exchange capacity of a reference material selected from non-hybridized zeolite A. Such reference zeolite A in fully Na-exchanged form has a theoretical cation exchange capacity of about 7 meq/g, typically 5–7 meq/g, e.g., 6 meq/g in practice. Such material for reference purposes suitably has a particle size of from about 1 micron to about 10 microns.

The occluded nonsilicate cobuilder can be selected from (i) the group consisting of occluded phosphate, occluded carbonate, occluded borate, occluded nitrate, occluded nitrite, occluded sulfate, occluded $Na_2O$ and mixtures thereof; and (ii) mixtures of said occluded nonsilicate cobuilder and occluded silicate; provided that in any of said mixtures of occluded nonsilicate and occluded silicate, the weight fraction of occluded silicate is no more than about 0.99, preferably no more than about 0.80.

The invention also encompasses a detergent composition comprising: (a) from about 0.1% to about 99% of a builder system comprising, in part, a particulate inorganic ion-exchanging builder material, said builder material comprising a hybrid of crystalline aluminosilicate and an occluded cobuilder, said hybrid further comprising at least one adsorbed or externally chemically bonded cobuilder or adjunct other than said occluded cobuilder, and (b) from about 0.1% to about 99% of detergent adjuncts other than any adjunct of said builder system.

The adsorbed or externally chemically bonded cobuilder or adjunct can be a builder adjunct or a nonbuilder adjunct. When the externally chemically bonded cobuilder or adjunct is a nonbuilder adjunct, it preferably reduces the negative surface charge of the hybrid relative to tile nontreated hybrid, whereby said component (a) has improved compatibility with cationically charged surfactants and/or enzymes.

When such surface treatment of the hybrid is practiced, the detergent composition of the invention can readily accommodate a detergent adjunct comprising at least one cationic detersive surfactant. Other detergent adjuncts may be present, such as at least one anionic detersive surfactant, especially mid-chain branched types, in addition to said cationic detersive surfactant.

In general, said occluded cobuilder is selected from the group consisting of occluded silicate cobuilder, occluded nonsilicate cobuilder, and mixtures thereof.

Thus there are preferred embodiments wherein said occluded cobuilder is an occluded silicate cobuilder, such embodiments include those wherein tile hybrid is fully in accordance with the above-identified Englehard patent publication.

However the invention also encompasses embodiments wherein said occluded cobuilder is selected from the group consisting of occluded nonsilicate cobuilder and mixtures of occluded nonsilicate cobuilder and occluded silicate cobuilder; and wherein said occluded nonsilicate cobuilder is selected from the group consisting of occluded nitrate, occluded phosphate, occluded carbonate, occluded borate, occluded nitrate, occluded sulfate, occluded $Na_2O$ and mixtures thereof. In this case, certain art-known occluded zeolites, outside of the above-identified Engelhard publication, are useful herein, such occluded zeolites are not known to the inventors as having been used in any laundry detergent, especially modern high-density granules or tablet form-detergents.

In another embodiment the present invention encompasses a detergent composition comprising (a) from about 0.1% to about 99% of a builder system comprising, in part, a particulate inorganic ion-exchanging builder material, said builder material comprising a hybrid of crystalline aluminosilicate and an occluded cobuilder; and (b) from about 0.1% to about 99% of at least one detergent adjunct selected from the croup consisting of: (i) detersive surfactants having at least one biodegiradably branched hydrophobe; (ii) organic polymeric materials selected from the group consisting of end-capped oligomeric esters, hydrophobically modified polyacrylates, terpolymers comprising maleate or acrylate, polymeric dye transfer inhibitors, polyimine derivatives, and mixtures thereof; (iii) oxygen bleach promoting materials selected from the group consisting of organic bleach boosters, transition-metal bleach catalysts, photobleaches, bleach-promoting enzymes and mixtures thereof; (iv) fabric care promoting agents other than softeners or said organic polymeric materials; and (v) mixtures of (i)–(iv).

In this latter embodiment, said hybrid preferably comprises at least about 0.01 weight fraction of said builder system and wherein said occluded cobuilder is selected from group consisting of occluded silicate cobuilder, occluded nonsilicate cobuilder and mixtures of said occluded silicate cobuilder and said occluded silicate cobuilder, and wherein said occluded nonsilicate cobuilder, when present, is present at a weight ratio to occluded silicate cobuilder of from about 1:1000 to about 1000:1 and is selected from the group consisting of occluded nitrate, occluded phosphate, occluded carbonate, occluded borate, occluded nitrite, occluded sulfate, occluded $Na_2O$ and mixtures thereof.

The builder system itself can be varied. Thus there is encompassed a detergent composition as defined hereinabove wherein said hybrid comprises at least about 0.10 weight fraction of said builder system and wherein from about 0.10 to about 0.90 weight fraction of said builder system is selected from the group consisting of zeolite A, zeolite B, zeolite P, zeolite MAP, zeolite X, zeolite AX, clays, layer silicates, chain silicates, soluble silicates, citrates, nitrilotriacetates, ethercarboxylates (preferably carboxymethyloxysuccinate, tartrate monosuccinate, tartrate disuccinate, oxydisuccinate or mixtures thereof), carbonates (preferably sodium carbonate and/or sodium bicarbonate), polyacetal carboxylates, and mixtures thereof. Aminofunctional variants of the ether carboxylates can also be used. (Desirably for cost reasons at least 80% by weight of the soluble or exchangeable cations inherent in the builder system are sodium, however other soluble cations, especially potassium, can be included at varying levels and calcium and/or magnesium may also be present. Magnesium silicate in particular can be used as a cobuilder or as an adjunct desirable for processing reasons). Other highly desirable detergent compositions comprise the hybrid builder together with an additional specified builder material as described in more detail hereinafter.

As noted the invention encompasses embodiments wherein the hybrid is in accordance with the above-identified Engelhard patent, and other embodiments wherein the hybrid is not in accordance with Engelhard. Such embodiments include any detergent composition wherein the builder system has measurable hydroxysodalite as evidenced by peaks at 14.0, 24.3 and 25.1 degrees 2 theta in the XRD powder pattern of the builder system taken as a whole; or wherein the hybrid has measurable hydroxysodalite as evidenced by peaks at 14.0, 24.3 and 25.1 degrees 2 theta in the XRD powder pattern of the hybrid examined on its own.

In certain especially preferred embodiments, the detergent compositions incorporate biodezradably branched detersive surfactants. These embodiments include detergent compositions wherein said detergent adjunct comprises at least one detersive surfactant having at least one biodegradably branched hydrophobe, said surfactant being selected from mid-chain-$C_1$–$C_4$-branched $C_8$–$C_{18}$-alkyl sulfates, mid-chain-$C_1$–$C_4$-branched $C_8$–$C_{18}$-alkyl ethoxylated, propoxylated or butoxylated alcohols, mid-chain-$C_1$–$C_4$-branched $C_8$–$C_{18}$-alkyl ethoxysulfates, mid-chain-$C_1$–$C_4$-branched $C_8$–$C_{16}$-alkyl benzenesulfonates and mixtures thereof; and wherein said detersive surfactant is present at a level of from about 0.1% to about 30% by weight of said detergent composition.

The invention is quite tolerant of variations in quality of the hybrid material. Thus the invention includes detergent compositions wherein said hybrid builder material has a capacity to sequester calcium anywhere in excess of the amount of charge inducing aluminum in the crystals of the hybrid builder material. Preferably, however, said hybrid builder material comprises is characterized by a calcium ion exchange capacity of at least 25% greater than the calcium ion exchange capacity of a reference material selected from non-hybridized zeolite A.

Also in preferred embodiments, the total $SiO_2$ in said hybrid builder material can be from 1.02 to 1.50 times the framework $SiO_2$ as determined by comparison of x-ray diffraction, x-ray fluorescence and $^{29}Si$ NMR analysis.

In another preferred embodiment the invention includes a detergent composition comprising: (a) from about 0.1% to about 99% of a builder system comprising, in part, a particulate inorganic ion-exchanging builder material comprising a hybrid of crystalline aluminosilicate and occluded silicate having a $SiO_2Al_2O_3$ ratio below 3 and formed by a process comprising the step of adding an aluminum source to a concentrated silicate solution having a pH above 12, said silicate solution having been at least partially depolymerized by heating prior to the addition of said aluminum source; and (b) from about 0.1% to about 99% of at least one detergent adjunct selected from the group consisting of: (i) detersive surfactants having at least one biodegradably branched hydrophobe; (ii) organic polymeric materials selected from the group consisting of end capped olicomeric esters, hydrophobically modified polyacrylates, terpolymers comprising maleate or acrylate, polymeric dye transfer inhibitors, polyimine derivatives, and mixtures thereof; (iii) oxygen bleach promoting materials selected from the group consisting of organic bleach boosters, transition-metal bleach catalysts, photobleaches, bleach-promoting enzymes and mixtures thereof; (iv) fabric care promoting agents other than softeners or said organic polymeric materials; and (v) mixtures of (i)–(iv).

In such embodiments said step of depolymerizing said sodium silicate solution preferably comprises heating at temperatures of from 50° C. to 85° C., for a period of 10 minutes or longer.

Such embodiments include those wherein said composition comprises soluble silicate as a non-occluded cobuilder and wherein the total level of soluble silicate in said composition as a whole is limited, and is preferably no more than the equivalent of about 3% by weight of the composition of 2.0 r sodium silicate.

Also included are the compositions wherein the hybrid has measurable hydroxysodalite as evidenced by XRD powder pattern; compositions wherein said builder system comprises said particulate hybrid aluminosilicate material in conjunction with at least one traditional builder material, at a ratio of hybrid aluminosilicate to traditional builder material of from 5:1 to about to about 1:5; compositions which comprise as an adjunct a low level of chelant, (preferably less than about 2% by weight of the composition, more preferably from about 0.1% to about 1.5%; highly preferred chelants include DTPA, EDTA, S,S'-EDDS and mixtures thereof,); compositions comprising as an adjunct a dual-chelant system having at least one nonphosphonate amino-functional chelant and at least one phosphonate-functional chelant; and compositions comprising as an adjunct a low level of polycarboxylate polymer, (preferably a Murphy-type system, polymer levels, e.g., less than about 2%).

The present invention has other embodiments and ramifications, such as a detergent composition comprising: (a) from about 0.1% to about 99% of a builder system comprising, in part, a particulate inorganic ion-exchanging builder material comprising a hybrid of crystalline aluminosilicate and occluded cobuilder, said hybrid having a $SiO_2/Al_2O_3$ ratio below 3 and formed by a process comprising the step of adding an aluminum source to a concentrated silicate solution having a pH above 12, said silicate solution having been at least partially depolymerized by heating prior to the addition of said aluminum source and further, optionally but preferably, at least one source of occludable nonsilicate cobuilder having been added in any step and/or further, optionally but preferably, at least one surface treating agent having been applied to the external surfaces of said hybrid after formation thereof; subject to at least one of the following provisions with respect to the composition of said builder system:

the builder system has measurable hydroxysodalite as evidenced by peaks at 14.0, 24.3 and 25.1 degrees 2 theta in the XRD powder pattern of the builder system taken as a whole and/or the hybrid has measurable hydroxysodalite as evidenced by peaks at 14.0, 24.3 and 25.1 degrees 2 theta in the XRD powder pattern of the builder system taken on its own and/or the hybrid has measurable occluded nonsilicate cobuilder as evidenced directly and/or indirectly by any combination of elemental analysis, XRD powder pattern, $^{29}Si$ NMR or other known techniques and/or the hybrid has measurably different wetting and/or surface charge as compared with a non-surface treated hybrid; and (b) from about 0.1% to about 99% of at least one detergent adjunct.

In certain preferred examples of such compositions, said hybrid comprises occluded silicate; wherein said hybrid is characterized by $^{29}Si$ NMR peaks in the range −81 to −85 ppm.

In other preferred examples of such compositions, said detergent composition has the form of a laundry bar, tablet, low-density granule or powder, high-density granule or powder (e.g. >600 g/liter), paste, or gel or liquid having dispersed solids, wherein said hybrid has a measurable improvement in the sum of Calcium binding and Magnesium binding as compared to Zeolite A, delta-layered silicates and mixtures thereof.

Moreover the present invention encompasses a detergent composition comprising: (a) from about 0.1% to about 99% of a builder system comprising, in part, a particulate inorganic ion-exchanging builder material comprising a hybrid of crystalline aluminosilicate and occluded cobuilder, said hybrid having a $SiO_2/Al_2O_3$ ratio below 3 and formed by a process comprising the step of adding an aluminum source to a concentrated silicate solution having a pH above 12, said silicate solution having been at least partially depolymerized by heating prior to the addition of said aluminum source and further, optionally but preferably, at least one source of occludable nonsilicate cobuilder having been added in any step and/or further, optionally but preferably, at least one surface treating agent having been applied to the external surfaces of said hybrid after formation thereof; and (b) from about 0.1% to about 99% of at least one detersive adjunct; provided that said detergent composition has solid form and the process for preparing the detergent composition comprises at least one step of combining said hybrid material with a film-forming polymer.

Equally included in the invention are detergent compositions as generally described hereinabove wherein the hybrid material has measurably different wetting and/or surface charge as compared with a non-surface treated hybrid.

In one preferred embodiment of such compositions, there is encompassed herein the detergent composition wherein the hybrid material has measurably different wetting and/or surface charge as compared with a non-surface treated hybrid; and wherein said measurable difference is accomplished by a step of treating the hybrid material with PEG or a film-forming polymer.

Builder System

In more detail, the present invention includes detergent compositions having a builder system. A "builder system" as defined herein comprises one or more detergent ingredients known in the art as "builders", provided that there is included at least one "hybrid" or "occluded" aluminosilicate builder as defined in more detail hereinafter.

In certain embodiments, the builder system differs from builder systems disclosed in WO98/42622 in that the hybrid builder material is different from the hybrids of WO98/42622.

In other embodiments, the builder system can be identical with those disclosed in WO98/42622, however, in this circumstance, the present detergent compositions have additional improving features deriving from the selection of adjuncts and/or the method of processing.

At a minimum, a "builder system" as defined herein must have at least one ingredient which helps control water hardness. "Water hardness" includes uncomplexed calcium arising from water and/or soils on dirty fabrics; more generally and typically, "water hardness" also includes other uncomplexed cations having the potential to precipitate under alkaline conditions, especially the alkaline earths, more particularly magnesium. Well-known conventional builders include sodium tripolyphosphate, a "soluble complexing builder" which has a range of functions and benefits beyond complexation of calcium, such functions include, for example, peptization of inorganic soils. Another well-known builder is zeolite A, especially 0.01–10 micron zeolite A in sodium form. This builder is a relatively insoluble crystalline material, which functions by ion exchange and is sometimes termed an "ion exchanging builder". Yet another well-known builder is sodium carbonate. Sodium carbonate functions as a "precipitating builder"—it reduces water hardness by forming one or more types of insoluble complex, such as calcium carbonate. Builder systems herein can in general include one or more water-soluble complexing builders and/or one or more ion-exchanging builders and/or one or more precipitating builders, provided that an essential hybrid component as defined hereinafter is present.

Art-disclosed builder systems often also include transition-metal binding materials known as chelants, and/or organic polymers, such as sodium polyacrylate, which have a builder function, however for the purposes of unambiguously accounting for materials in the present formulations, the convention will be used of separately accounting for chelants and those organic polymers which have a builder function—they will be added up with separately added detergent adjuncts. This is for purposes of formula accounting and does not exclude such materials, in practice, from being coprocessed with the "builder system", for example into high density agglomerated particles.

Typical builder systems herein are further exemplified by:

- a builder system comprising a hybrid as defined hereinafter, together with a layered silicate and sodium carbonate;
- a builder system comprising, a hybrid as defined hereinafter, together with sodium tripolyphosphate;
- a builder system comprising a hybrid as defined hereinafter, together with sodium carbonate and a member selected from the group consisting of sodium oxydisuccinate, sodium carboxymethyloxysuccinate, sodium nitrilotriacetate, sodium citrate, and mixtures thereof;
- a builder system comprising, a hybrid as defined hereinafter, together with zeolite A and sodium carbonate; and
- a builder system comprising a hybrid as defined hereinafter having a film-forming polymeric coating, optionally together with one or more of zeolite A, sodium carbonate, and sodium citrate (recall that in such a case, the level of polymer for formula accounting purposes is accounted into the detergent adjunct outside of the builder system).

In terms of essential component, the detergent compositions and builder systems herein are required to include at least one crystalline, particulate, inorganic ion exchanging builder material comprising a hybrid of crystalline zeolitic aluminosilicate and at least one occluded cobuilder. The term "hybrid" indicates that the aluminosilicate and cobuilder are integrated into the same crystal, as distinct from a simple mixture of separate crystals of the components. The term "occluded" further particularizes the location of one material relative to the other by specifying that the cobuilder is included into rather than simply eternally onto the aluminosilicate crystals. The term "hybrid" may be used herein as a shorthand; when unqualified, it encompasses all suitable particulate crystalline aluminosilicates, having whatever kind of occluded material which helps detergent performance.

In alternate terms, "hybrid" or "occluded" builder materials herein also encompasses all those zeolite compositions comprising both a cobuilder and a zeolite useful as a builder, provided that the composition is the product of a process comprising the step of adding an aluminum source to a concentrated silicate solution or silicate-cobuilder solution having a pH above 12, said silicate solution or silicate-cobuilder solution having been at least partially depolymerized, preferably by heating, prior to the addition of said aluminum source. In such compositions, the cobuilder may vary widely, and includes phosphate, carbonate, borate, nitrate, nitrite, sulfate, $Na_2O$, NaOH and mixtures thereof. This alternate definition emphasizes that the present invention is not limited to a particular theory of operation.

In general, the hybrid builder materials herein can be categorized into a number of distinct classes, depending on the material that is occluded into the aluminosilicate crystals.

(a) hybrids comprising occluded silicate;

(b) hybrids comprising occluded nonsilicate cobuilder;

(c) hybrids comprising both occluded silicate and occluded nonsilicate cobuilder.

The hybrid builder materials can further aryl depending on the crystal type, thus hybrids herein can in general be hybrids based on a zeolite A crystal type, a zeolite P or gismondine crystal type, AX type, or any other crystal type known to be associated with ion-exchanging aluminosilicate materials.

Hybrids comprising occluded silicate include those of WO 98/42622. Engelhard, which are disclosed in detail hereinafter.

Hybrids comprising occluded nonsilicate cobuilder include the particulate crystalline aluminosilicates having occluded material selected the group consisting of occluded phosphate, occluded carbonate, occluded borate, occluded nitrate, occluded nitrite, occluded sulfate, occluded $Na_2O$, occluded NaOH and mixtures thereof. The adjective "occluded" is used to emphasize that not only is the selected material to be present, it must be located in the aluminosilicate crystals. The precise location may vary, though in most instances, it is believed that at least a portion of the occluded material lies outside the smallest zeolite cages while lying at least in part inside the larger zeolite cages.

Mixtures of hybrids can in general be used in any proportion. Such mixtures include mixtures of a hybrid according to WO 98/42622 with mixtures of a hybrid varying from WO 98/42622 through possession of at least one of (i) a different, nonsilicate occluded cobuilder or (ii) a distinct crystal type as compared with WO 98/42622.

Hybrid materials herein can have a range of particle sizes, primary crystals in the size range of from about 0.01 to about 20 microns being suitable, from about 1 micron to about 10 micron and having a good ability to diffract X-rays being preferred. Such primary crystals can be agglomerated into larger aggregates to minimize dusting and/or segregation in fully-formulated laundry detergents. All hybrids herein can in general vary in primary crystallite size and degree of crystal perfection.

Hybrid materials herein can have a range of occluded cobuilder content, for example from about 0.001 to about 1.0 number fraction of available occlusion sites can be occupied by occluded cobuilder. Hybrids having combinations of occluded and adsorbed cobuilder are possible.

Hybrid materials herein can have varying cation composition, for example including hydrogen or ammonium or even in part calcium or magnesium, though typically the preferred cation is sodium. Potassium or lithium, if present, will be in rather limited proportion, e.g., less than about 0.01% of available exchangeable sites. Charge-balancing amounts of such cations can be present, or sub-charge balancing amounts, for example when the hybrid material is extensively washed in pure water.

Hybrid materials herein can optionally have adsorbed or occluded organic adjuncts, such as perfumes. Wherever located in a manufactured formulation, perfumes, like organic polymeric builders or chelants, are added up, for formula accounting purposes, outside of the builder system.

Hybrid materials herein can have varying degree of hydration, for example if used in detergent compositions which are aqueous suspensions, they can be fully hydrated. In other nonlimiting examples, if the hybrid material is incorporated in a nonaqueous liquid detergent, a high-density granular detergent comprising bleach or bleach precursor, or a composition comprising a hydrolytically labile perfume precursor or pro-perfume, the hybrid material may be anhydrous or only partially hydrated.

Preferred hybrid builders having occluded nonsilicate cobuilder herein have occluded materials which are typically relatively small inorganic anions, e.g., occluded phosphate, occluded carbonate, occluded borate, occluded nitrate, occluded nitrite, occluded sulfate, and mixtures thereof.

A preferred group of hybrid builders having occluded nonsilicate cobuilder have occluded materials which have an anionic charge greater than one, e.g., occluded phosphate, occluded carbonate, occluded sulfate, and mixtures thereof.

A preferred group of hybrid builders having occluded nonsilicate cobuilder have occluded materials which are phosphorus-free and boron-free, e.g., occluded carbonate, occluded nitrate, occluded nitrite, occluded sulfate, and mixtures thereof.

A preferred group of hybrid builders having occluded nonsilicate cobuilder have occluded materials which are nitrite-free, e.g., occluded carbonate, occluded nitrate, occluded sulfate, and mixtures thereof.

Another preferred group of hybrid builders having occluded nonsilicate cobuilder have occluded materials which are nitrate-free, nitrite-free, boron-free and phosphorus-free, e.g., occluded carbonate, occluded sulfate, occluded $Na_2O$, occluded NaOH and mixtures thereof.

Unless otherwise noted, hybrid builder herein is characterized by at least one of:

(i) a 5-minute rate of calcium sequestration at least 15%, preferably at least 20%, more preferably at least 25% greater than that of zeolite A having comparable crystal size; and/or (ii) a 15-minute or equilibrium capacity to sequester calcium in excess of the amount of charge inducing, aluminum in the zeolitic aluminosilicate. Alternately, said hybrid is characterized by a 15-minute or equilibrium calcium ion exchange capacity of at least 15% greater, preferably at least 20%, more preferably at least 25% greater than the calcium ion exchange capacity of a reference material selected from non-hybridized zeolite A. Such reference zeolite A in fully Na-exchanged form has a theoretical cation exchange capacity of about 7 meq/g, typically 5–7 meq/g, e.g. 6 meq/g in practice wherein the abbreviation "meq/g" stands for milliequivalents per gram. Such material for reference purposes suitably has a particle size of from about 1 micron to about 10 microns.

See, for example, the methods disclosed in WO 98/42622 and further detailed hereinafter, especially Table I and the discussion of percentage improvement following immediately thereafter which illustrate how the above-identified percentages are to be calculated.

Levels of builder system in the completed laundry detergent powder, syndet bar, gel, tablet or pouch can vary widely, for example from 0.1% to about 99% of a builder system comprising the essential hybrid material. The proportion of the hybrid aluminosilicate builder material can likewise vary, comprising from about 0.01 to 1.0, more preferably 0.10 to 1.0, weight fraction of the builder system.

Hybrid Aluminosilicate Not According to WO 98/42622

It is to be emphasized that the present invention includes embodiments in which, by way of hybrid material, only hybrid aluminosilicates not according to WO 98/42622 are used as an essential component. These hybrids in general can be selected in an proportion from:

(i) silicate-containing hybrids of zeolites having crystal type which differs by X-ray diffraction from those disclosed in WO 98/42622 and (ii) hybrids of a crystalline aluminosilicate and at least one non-silica or nonsilicate occluded cobuilder. Preferably this cobuilder is selected from the group consisting of phosphate, carbonate, borate, nitrate, nitrite, sulfate, $Na_2O$, NaOH and mixtures thereof.

Of course, combinations of silicate-type hybrids as per WO 98/42622 and hybrids having nonsilicate cobuilder selected from the group consisting of phosphate, carbonate, borate, nitrate, nitrite, sulfate, $Na_2O$ and mixtures thereof in all proportions are also encompassed.

The hybrids not according to WO 98/42622 herein generally include those known in the art of zeolite manufacture, see for example "Zeolite Chemistry and Catalysts", Ed. J. A. Rabo. ACS Monograph Series. Vol. 171, American Chemical Society. Washington D.C. 1976, incorporated herein by reference. See more particularly the same Volume, Chapter 5. "Salt Occlusion in Zeolite Crystals", pages 332–349 and references cited therein. Such materials include, for example, borate-occluded, hydroxide-occluded, or nitrate- or other nitrate salt-occluded zeolite A. See, for example, the work by Barrer, or by Liquornik and Marcus referred to in the cited standard texts. The occluded salt molecules may, or may not penetrate the sodalite cages of the zeolite, and can be arranged in the larger cages. In general, the occlusion may be of the so-called reversible type, or may be non-reversible.

Occlusion for the present purposes is best conducted with sodium as cation and without a transition-metal as the cation, though more generally, transition-metal or silver cation occluded variations are possible and can have beneficial effects, such as enhancement of antimicrobial activity of a detergent composition. In addition to occlusion of carbonate, nitrate, nitrite, sulfate, phosphate, borate, mixtures thereof, and mixtures thereof with silicate in any proportion, the present invention also encompasses occlusion of $Na_2O$ in zeolites, such as $Na_2O$-occluded zeolite A. It is known that certain zeolites tend to decompose nitrate catalytically to $NaNO_2$ (chabazite and mordenite) and even to produce $Na_2O$.

The hybrid aluminosilicates herein can be prepared by any known method, see for example the ACS monograph cited supra and references therein, such methods can be aqueous-based, for example using the above-identified anions in a method otherwise similar to the Engelhard WO 98/42622 method or variations thereof, or can be non-aqueous or melt-based methods.

Preferred hybrids and combinations include those wherein the zeolite is zeolite A. B, P, X, AX or MAP; sodium is the sole cation; and the occluded cobuilder is selected from carbonate, hydroxide and $Na_2O$.

Suitable levels are from about 0.1% to about 80%, preferably from about 0.5% to about 30%, by weight, of the hybrid aluminosilicate when it is used alone.

Suitable levels of a builder system in the present detergent compositions are from about 0.1% to about 85%, preferably from about 1% to about 40%, by weight.

Builders other than the hybrid aluminosilicate are conventional and can, for example, be selected from water-soluble organic builders such as 2,2'-oxydisuccinate sodium salts, citric acid sodium salts, carboxymethyloxysuccinate sodium salts, nitrilotriacetic acid sodium salts and the like; water-insoluble inorganic builders such as zeolites A, P, B, X, or any of their modifications, water-soluble organic builders such as various cellulosic polymers, and water-soluble inorganic builders such as sodium carbonates, sodium phosphates, sodium tripolyphosphates and the like, encompassing a wide range of calcium and/or magnesium binding capability and rate. The builder system can be complemented by one or more materials known as chelants, (chelants like, organic polymers, being added up separately in the formula accounting and being materials which generally have the capability to strongly bind transition metal ions or colloidal transition metal precipitates in aqueous alkaline media). Chelants suitable for use herein include ethylenediamine disuccinate sodium salts, EDTA, HEDP, DTPA and mixtures thereof; typical levels are in the range of from about 1 ppm to about 2% by weight of the detergent composition.

Hybrid Aluminosilicate Component According to WO 98/42622

The present invention includes embodiments in which a particular hybrid aluminosilicate according to WO 98/42622 is used as an essential component. This hybrid material can be obtained from Engelhard Corp. It is a crystalline zeolitic aluminosilicate having occluded silicate, and in WO 98/42622 it is termed a "hybrid zeolite/silica composition" (HZSC). The terms "aluminosilicate having occluded silica", "aluminosilicate having occluded silicate", "hybrid zeolite/silica composition", and the acronym "HZSC" are used interchangeably.

According to WO 98/42622, HZSC materials may be prepared by-crystallizing high aluminum zeolites in highly alkaline/high silica environments. Chemical analysis indicates an excess of silica in the HZSC beyond that inherent to their crystalline frameworks. Such materials, at least in certain cases, demonstrate sequestration capacities for cations such as calcium which exceed the amount of zeolitic aluminum available for ion-exchange and even exceed the theoretical limit possible for a zeolite. Thus, HZSC materials and their properties are potentially different both in degree and in kind from those of a conventional zeolite.

According to the inventors of WO 98/42622, the "key mechanism in the effectiveness of HZSC materials is derived from the ability of zeolite cases to isolate and stabilize small, highly charged silicate units." The inventors of the present invention remark that alternative theories can be advanced, for example it is known that small cobuilder polyanions (in this case silicate) can reduce electrostatic repulsions between cations in aluminosilicates. This can stabilize both sodium-exchanged and calcium-exchanged occluded aluminosilicates relative to the non-occluded aluminosilicates. Such theory would be broadly consistent with the compositional description of HZSC. While less likely in view of the WO 98/42622 data, sodium metasilicate, if intimately mixed with zeolite, could alternately provide compositions, effectively made by the processes of WO 98/42622, which act more effectively than builder compositions hitherto available, for example by an improved concerted action as a precipitating cobuilder, together with the zeolite. Theory should therefore not be considered limiting of the present invention. Rather, the value of WO 98/42622 as a source of builder for the present invention may lie to a greater extent in the product of the described processes than in the precise mode of description of the compositions.

The above cautions notwithstanding, WO 98/42622 discloses that silicate units are introduced during synthesis of HZSC by providing an environment wherein silica in the reaction mixture is depolymerized to highly charged predominantly monomeric units before crystallization begins. The occluded silicate units of the HZSC are visible in $^{29}Si$ NMR spectra. The HZSC as a whole is stated to be "more powerful" in complexing multivalent cations than are existing zeolites, silicates or mixtures thereof. The zeolite framework and occluded silicate units are stated to "act in concert, as a new type of hybrid composition, showing properties neither zeolites, silicates nor physical blends of the two demonstrate". In addition to high capacity for ion exchange, the HZSC's demonstrate unusually rapid rates of sequestration, important in applications such as detergent building.

By way of technical background, but without being limited by theory, the sequestration properties of zeolites arises from their ability to ion-exchange. The ion-exchange ability derives from isomorphous substitution of Al(III) for Si(IV) in classical zeolite frameworks which results in a net excess of negative charge in the aluminosilicate framework. This requires counterbalancing by the inclusion of exchangeable cations. Excess charge, and thus exchange capacity, is a function of aluminum content. "Detergent" zeolites, according to WO 98/42622, have hitherto been restricted to the relatively short list of "high aluminum" zeolites. By Lowenstein's Rule, the Si/Al ratio of a zeolite may, not be lower than 1.0 and concomitantly, the aluminum content may not exceed 7.0 meq per gram or an anhydrous material in the sodium form. This capacity may alternatively be expressed as 197 mg CaO per gram zeolite (anhydrous) when water softening is the desired exchange reaction. Zeolites demonstrating this maximum aluminum content include Zeolite A, high aluminum analogs of Zeolite X and high aluminum analogs of gismondine (often referred to as Zeolite B, P or MAP).

Also according to WO 98/42622, while Zeolite A has been the "detergent zeolite" of choice for years, the possibility of employing a high aluminum version of gismondine-type materials in calcium sequestration has been known for more than a generation (U.S. Pat. No. 3,112,176 Haden et al.) and has recently found renewed interest (for example, U.S. Pat. No. 5,512,266 Brown, et al.). In addition to zeolites, the ability of silicates to complex ions such as calcium and especially magnesium has long been known and sodium silicate has long been employed as a cheap, low performance detergent builder. More recently, complex silicates such as Hoechst SKS-6 have been developed which are claimed to be competitive with higher performance zeolites.

Moreover, according to WO 98/42622, the capacity for silicates to complex ions such as calcium and magnesium is inversely proportional to silicate chain length and directly proportional to the electronic charge on that chain fragment. Silicates depolymerize with increasing alkalinity (See FIG. 1 of WO 98/42622). At moderate pH (where wash cycles are conducted) silicates are polymeric. However, at much higher pH's silica not only becomes predominantly monomeric, but also that monomer may possess multiple charges. If such small, highly charged fragments could be exposed to solutions bearing multivalent cations, very powerful high capacity sequestration agents would result. The inventors of WO 98/42622 assert that they have created such a situation by isolating and stabilizing substantial concentrations of such species within zeolite cages where ions such as calcium and magnesium are free to enter from an aqueous environment (such as wash water) and react with these powerful sequestration agents.

WO 98/42622 further discloses that HZSC compositions can be prepared by reacting a finely divided aluminum source such as a dried aluminosilicate gel or powdered gibbsite and more preferably finely divided metakaolin with concentrated silicate solutions at pH values above 12 at temperatures ranging from about ambient to about 100° C. and at atmospheric pressure. It is crucial for the preparation of the HZSC compositions that the aluminum source must be added last to the reaction mixture. Thus, if all the ingredients of the reaction mixture are added together and heated to crystallization temperature, a conventional zeolite of the prior art will be formed, and the HZSC materials of WO 98/42622 will not be formed.

According to WO 98/42622, it is even more desirable to prepare HZSC compositions by heating the reaction mixture at temperatures of from 5° C. to 85° C. before the addition of the aluminum source for a period of time of about 30 minutes or longer. While not wishing to be bound by any theory of operation, it appears that heating the reaction mixture for about 30 minutes prior to aluminum addition allows the silicate to depolymerize and form the predominantly occluded silicate units previously discussed.

According to WO 98/42622, HZSC's can also be prepared by reacting finely divided metakaolin with concentrated sodium silicate solutions at pH values above 12 at temperatures ranging from about ambient to about 100° C. and at atmospheric pressure.

WO 98/42622 also states a preference to use high purity metakaolins, especially those low in iron and titania, when color is a consideration. For example, metakaolin having an $Fe_2O_3$ content below 1%, preferably below 0.5% by weight and a $TiO_2$ content below 2% by weight preferably below 1% by weight are useful. The metakaolin should be in powder form. These powders may be prepared by removing grit and coarse impurities from kaolin ores, usually fractionating the degritted crude, drying the resulting slurry of fractionated hydrous kaolin, pulverizing the dried material, calcining in conventional manner to produce metakaolin (see, for example, U.S. Pat. No. 3,112,176 (Haden et al.)), and pulverizing the metakaolin by means of a hammer mill or the like. U.S. Pat. No. 3,014,836 Proctor et al. is cross-referenced herein for its disclosure of producing calcined kaolin pigments from an acidic (bleached) filter cake of kaolin by steps including drying, pulverizing, calcining and repulverizing; in practice of this invention the procedures of Proctor et al must be modified by using lower calcination temperature to produce the desired metakaolin form of calcined clay. The kaolin ore may be upgraded by means such as froth flotation, magnetic purification, selective flocculation, mechanical delamination, grinding or combinations thereof before drying, pulverization, calcination and repulverization. In many commercial operations, a chemically dispersed slip of the kaolin is dried in a spray dryer, forming microspheres. See, for example, U.S. Pat. No. 3,586,523 Fanselow et al. The resulting microspheres of hydrous (uncalcined) kaolin are then pulverized, calcined and repulverized, as taught in the patent of Fanselow et al.

Further according to WO 98/42622, the particle sizes of the hydrous kaolinite precursor of the metakaolin starting, material affect the size of the HZSC product. Since HZSC products having a fine particle size are usually preferred, fine particle size metakaolins obtained from fine particle size hydrous kaolins are recommended. These particle sizes are most frequently measured by kaolin producers as values obtained by sedimentation, typically using a Sedigraph® 5100 analyzer (supplied by Micromeretics Corporation) and the values are reported as "equivalent spherical diameter" (e.s.d.). Use of other measuring instruments ma rive somewhat different values. In Example 3 of WO 98/42622, reproduced below as "HZSC Synthesis Example 1", illustrative of the WO 98/42622 process, typical samples of the hydrous kaolin precursor of the metakaolin are about 90% by weight finer than 1 micron, e.s.d., as measured using the Sedigraph® 5100 instrument. The high brightness hydrous kaolin used in this example can be prepared from a coarse white Georgia kaolin crude by steps comprising degritting, froth flotation to remove colored impurities, mechanical delamination and fractionation. The fractionated product, about 90% by weight finer than 1 micron e.s.d., can be recovered as a dispersed fluid aqueous slip that can be spray dried, pulverized, calcined to metakaolin condition and repulverized. The particle size of the repulverized metakaolin is coarser than that of the hydrous kaolin.

HZSC compositions of WO 98/42622 can moreover be prepared by synthesizing those zeolitic molecular sieves that have a high $Al_2O_3/SiO_2$ molar ratio, e.g., $SiO_2/Al_2O_3$ molar ratios in the range of 2 to 3 according to the teachings of the prior art, with the crucial exception that the aluminum source is added last to the reaction mixture. Species include type P (also referred to as type B), zeolite A, high alumina X types and chabazite analogs.

After crystallization, the zeolite crystals are washed thoroughly with water, preferably deionized water, to remove sodium and spurious silica from the crystal surfaces. In some cases, some replacement of sodium by hydrogen may take place during washing. The crystals can be washed with solutions other than those of pure water.

About 5 to 40% of the silica content of the washed crystals is due to the occluded silicate species, usually to 20%. Thus, the total $SiO_2$ analysis as determined by conventional chemical analytical means will exceed that of the $SiO_2$ that would be expected based on the framework silica content as indicated by x-ray powder patterns and $^{29}Si$ NMR analysis of the HZSC composition. The occluded silicate portion of this silica is readily ascertained from the $^{29}Si$ NMR peaks at about −81 to −85 ppm.

$^{29}Si$ NMR has become a standard technique in the analysis of zeolites. The utility of this technique is based on the fact that different frequencies correspond to different electronic environments around the silicon, typically affected in zeolites by the chemistry of neighboring atoms and/or Si-O bond angles. $^{29}Si$ NMR detects all the Si, not just that which is associated with long-range crystallinity. This makes it sensitive to species that may not be detected by XRD.

HZSC Synthesis Example 1 (See Example 3 of WO 98/42622)

In order to prepare an improved builder, termed a Hybrid Zeolite-Silica Composition (HZSC), based on a gismondine-type aluminosilicate, the following procedure is applied.

1000 grams of fine particle size metakaolin obtained by calcining an ultrafine mechanically delaminated ground hydrous kaolin (90% by weight finer than 1 micron. e.s.d.), followed by pulverization is used. The powdered metakaolin is blended into an alkaline silicate solution containing 702 grams of N-Brand® sodium silicate solution and 1064 grams of NaOH in 4800 grams of deionized water which have been mixed and preheated to 72° C. The mixture is then reacted with vigorous stirring at 72° C. for eight hours at ambient pressure in an open stainless steel vessel. The crystalline product of the reaction is filtered and washed three times with 2000-ml lots of 72° C. deionized water. The crystalline product is dried in a forced air oven at 100° C. overnight. The crystalline product is analyzed and found to have a gross chemical Si/Al molar ratio of approximately 1.15 ($SiO_2/Al_2O_3$=2.30). An XRD powder pattern essentially identical to that of WO 98/42622 Example 1 and 2 (characteristic of gismondine-type zeolites) is obtained. This material is a HZSC (Hybrid Zeolite-Silica Composition) in accordance with WO 98/42622.

Additionally, the sodium content of this material as synthesized is found to be essentially equal to that of the silica (Na/Si=1.01), and to be substantially above the aluminum content on a molar basis (Na/Al=1.16). Generally, the aluminum content of a zeolite is expected to equal its cationic content in that each framework aluminum induces one net negative framework charge which is counterbalanced by cations in order to maintain electroneutrality. Extra sodium is a characteristic of HZSC and is believed to be the result of sodium in association with the occluded silicate species.

The average particle size (50% by weight finer than) of the crystalline product is 5.5 microns as determined by a Sedigraph® 5100.

HZSC Synthesis Example 2—See (See Example 10 of WO 98/42622)

In order to synthesize an improved builder, termed a Hybrid Zeolite-Silica Composition, in this example based on a Zeolite A framework, an HZSC material is prepared by the following procedure:

An alkaline silicate solution is prepared by dissolving 175.0 grams of NaOH and 99.0 grams of N-Brand® sodium silicate in 522.8 grams deionized water. After mixing and preheating the mixture to 80° C. 109.5 grams Metamax® metakaolin are added and the mixture reacted by stirring for one hour at 80° C. in a constant temperature bath. The resultant product is filtered and washed three times with 1000-ml lots of deionized water. The sample is then dried overnight in a forced air oven at 100° C. The product of this example demonstrates a strong, clean XRD powder pattern characteristic of Zeolite A. This material is then subjected to the hardness sequestration test of WO 98/42622 Example 7. The 15 second and 15 minute hardness removal readings are 43% and 51% respectively, showing that hardness sequestration is remarkably faster and substantially more thorough than that of unmodified Zeolite A. The hybrid composition offers substantial advantages over comparable zeolites in both rate and amount of hardness removal.

HZSC Synthesis Example 3 (See Example 13 of WO 98/42622)

In order to prepare an improved builder, termed a HZSC, based on a gismondine-type structure, the following procedure is followed:

An identical synthesis mixture to that of WO 98/42622 Example 12 is prepared but in a different order of addition/reaction. Thus, 74.97 pounds of deionized water, 42.7 pounds of 50% NaOH solution and 14.12 pounds of N-brand Sodium silicate are combined and heated under agitation to 72° C. in a stainless steel reactor. After an equilibration period of 30 minutes to allow silicate depolymerization. 20.0 pounds of Luminex brand metakaolin are added and the-mixture reacted under vigorous agitation for 8 hours at 72° C. After the reaction period, the product is washed and filtered on several large pan filters including multiple reslurries and rinses with substantial excess of deionized water.

The powder XRD pattern for this product is that of a highly crystalline material of a gismondine-type structure, consistent with that of WO 98/42622 Example 12. However, unlike Example 12 of WO 98/42622. $^{29}Si$ NMR shows a clear shoulder to the main peak at −81 to −85 ppm which is characteristic of an HZSC. Additionally, elemental analysis indicates the characteristic elevated Si/Al ratio (Si/Al=1.20) and sodium levels approaching molar silicon contents (Na/Si−1.01) and the characteristic excess of sodium to aluminum on a molar basis (Na/Al 1.21).

With the NMR indication of occluded silicate, exhaustive calcium exchange is conducted as in WO 98/42622 Example 12. Analysis of the exhaustively exchanged sample yields 23.8% CaO, 43.2% $SiO_2$ and 31.4% $Al_2O_3$ on a dry weight basis. Thus, the material contains approximately 7.20 meq/g Si, 6.16 meq/g Al and 8.49 meq/g Ca. The Ca/Al meq/g ratio approaching 1.4 is consistent with that of an HZSC and not consistent with that of a zeolite which is limited to 1.0. The calcium capacity approaching 8.5 meq/g is consistent with an HZSC and inconsistent with the 7.0 meq/g theoretical limit noted for zeolites.

The product of this example is an HZSC and not merely a high aluminum version of Zeolite P as prepared in WO 98/42622 Example 12 in spite of the fact that both are preparable using identical reactants, reaction times and temperatures and crystallization/washing equipment. It is therefore apparent that the order of reactant addition and probably full depolymerization of silicate are imperative in the formation of HZSC.

HZSC Synthesis Example 4 (See Example 14 of WO 98/42622)

In order to prepare an improved builder, termed a HZSC, based on a gismondine-type structure, and to demonstrate that aluminum sources other than metakaolin may be employed in the formation of HZSC, the following procedure is followed:

An aluminosilicate gel with gross composition approaching 1:1 Si/Al is prepared by dissolving, 2.95 kg of $NaAlO_2$, in 14.0 kg deionized water. To this is added 7.45 kg N-Brand® sodium silicate. The resultant gel is beaten with a high shear blade to a homogeneous appearing consistency. The homogenized gel is poured into stainless steel pans and is dried in an oven overnight at 100° C. A portion of this dried gel is pulverized and employed as dried aluminosilicate reactant. Thus, 89 grams of NaOH and 88 grams of N-Brand® sodium silicate are dissolved in 600 grams of deionized water and brought to a temperature of 72° C. under agitation. After equilibrating, 160 grams of the dried gel aluminosilicate reactant are added to the mixture under agitation and crystallized at 72° C. for 5.5 hours. The sample is washed and vacuum filtered with an excess of deionized water and dried at 100° C. overnight. The XRD powder pattern for this material is that of a highly crystalline gismondine-type structure. The $^{29}Si$ NMR spectrum shows a clear shoulder to the main peak at −81 to −85 ppm, characteristic of HZSC.

The HZSC material produced in accordance with this example is tested in accordance with the procedure set forth in WO 98/42622 Example 7.

The results obtained indicate that the material obtained by this example possess the same rapid cation exchange removal i.e. 48% in 15 seconds and 82% in 15 minutes as is possessed by the novel material of WO 98/42622 Example 3 (HZSC Synthesis Example 1 supra). Thus, this example establishes that aluminum sources other than metakaolin may be employed in the synthesis of HZSC materials.

Equilibrium Ion Exchange Capacity of a HZSC (See WO 98/42622 Example 5)

The full sequestration capacity of the crystalline product of HZSC Synthesis Example 1 (WO 98/42622 Example 3) at pH 10 (typical of wash water) is established by exchanging 3.0 grams of the material twice with 6.0 grams of $CaCl_2H_2O$ dissolved in 400 ml deionized water. The exchanges are each conducted for approximately 45 minutes at a temperature of 100° C. The sample is filtered and washed six times with approximately 100 cc deionized water to remove any spurious $CaCl_2$. The sample is then dried at 100° C. for approximately 12 hours. The sample is then subjected to conventional X-ray fluorescence chemical analysis techniques. The analysis reveals 23.5 weight % CaO, 42.0 weight % $SiO_2$, 31.9 weight % $Al_2O_3$ and approximately 1.0% other material on a dry weight basis. Thus, the material contains 7.0 meq/g Si, 6.26 meq/g Al and 8.37 meq/g Ca. Not only does this indicate 34% more calcium than can be accounted for by exchange with the available aluminum, it is nearly 20% greater than the 7.0 meq capacity theoretically possible for ion-exchange into a maximum aluminum zeolite. In terms of met CaO/g anhydrous zeolite (as in the Henkel test) this is a capacity of 236, well above the theoretical zeolite maximum of 197. Clearly, zeolite ion-exchange is not the only sequestration mechanism operating for the HZSC.

The Synthesis Examples supra demonstrate the preparation of the WO 98/42622 materials denoted "HZSC" for Hybrid Zeolite-Silica Compositions which demonstrate remarkable speed and thoroughness of multivalent cation complexation. This is especially useful in water softening/detergent building applications. These properties are asserted in WO 98/42622 to derive from the ability of zeolite cages to occlude small, highly charged silicate species. Whatever the theory with respect to the structure of these compositions, the zeolite and entrained or occluded silicate appear to act in concert as a hybrid composition showing properties that neither zeolites, specifically tested silicates, nor physical blends of the two demonstrate.

In order to further demonstrate that the HZSC $^{29}Si$ NMR peaks at about −81 to −85 ppm are due to occluded silicate in HZSC compositions, samples of 2 MAP products marketed by Crosfield under the tradenames Zeocros 180 and Doucil A-24 are obtained and tested as received. XRD powder patterns for both samples indicate measurable hydroxysodalite as evidenced by peaks at 14.0, 24.3 and 25.1 degrees 2 theta, WO 98/42622 FIGS. 4*a, b*. A sample of high aluminum zeolite P made in accordance with the method of Haden (U.S. Pat. No. 3,112,176) is found to contain no discernible sodalite as determined by XRD. Representative samples of HZSC, including those of WO 98/42622 Examples 3 and 13, are examined by XRD and in no case is measurable sodalite present.

Pure zeolite MAP as prepared by the Haden method is subjected to $^{29}Si$ NMR analysis. It is found free of the shoulder at −81 to −85 ppm characteristic of HZSC, WO 98/42622 FIG. 5*a*.

In a publication by Carr. S. W., Gore, B, and Anderson, M. W., Chem Mater. 1997, Vol. 9, pgs. 1927–1932, it has been noted that as-received Crosfield zeolite MAPs contain an NMR shoulder near that characteristic of HZSC. With no such shoulder present in the pure MAP of Haden, an alternative explanation to Carr et al's claim of the shoulder being due to surface hydroxyl groups was sought by the inventors of WO 98/42622. Thus, the obtained a sample of hydroxysodalite and found it to have 1 large NMR peak centered at about −85.0 ppm. Published values for sodalite vary from about −83.5 to −85 ppm, with the variation largely due to the exact decree of hydration (see *High Resolution Solid State NMR of Silicates and Zeolites, G. Engelhardt and D. Michel, John Wiley & Sons, Chichester*, 1987). This hydroxysodalite was added by the WO 98/42622 inventors at a 1% level to the pure MAP and resulted in an XRD pattern, WO 98/42622 FIG. 4*c*, essentially identical to the sodalite-contaminated MAP of the commercial Crosfield products. WO 98/42622 FIGS. 4*a, b*. The WO 98/42622 inventors subjected this mixture to $^{29}Si$ NMR analysis and contrasted it to the pure MAP of Haden, sodalite contaminated Crosfield MAP, and HZSC of WO 98/42622 Example 3. Pure MAP has no shoulder in the region of −83 ppm, noted by Carr et al. (WO 98/42622 FIG. 5*a*). Addition of 1% sodalite yielded a spectrum. WO 98/42622 FIG. 5*c*, with the shoulder essentially identical (although weaker) to that of the sodalite-contaminated Crosfield product, WO 98/42622 FIG. 5*d*. Thus, the most reasonable explanation for Carr et al's observations is sodalite contamination in the as-received Crosfield MAPs. HZSC is free of these contaminants and yet still contains the characteristic NMR shoulder. It is most reasonable to assign this shoulder to occluded silicates which are also expected in this regime as no sodalite is present.

Hardness Sequestration Rate (See WO 98/42622 Example 7)

In order to assess the relative performance of HZSC-type materials versus zeolite as water softening agents in mixtures resembling wash water, sequestration tests are conducted in mixed calcium/magnesium solutions at 35° C. and pH 10. 1.5 liter charges of 1.03 molar calcium plus magnesium solutions are buffered with glycine solutions to a pH of 10. The Ca:Mg molar ratio is established at 3:1. The test hardness solutions are heated to 35° C. in a constant temperature bath at which point 0.45 gram charges of air-equilibrated HZSC or reference builders are added and the test mixtures agitated by an overhead stirrer at a rate of 200 rpm. Total hardness concentration is monitored by an Orion Model 9332BN total hardness electrode connected to an Orion Model 720A pH meter. Both the "instantaneous" and "equilibrium" hardness removal of a builder can be critical parameters depending upon the particular environment in which they are employed. Hardness removal at 15 seconds is taken as indicative of "instantaneous" hardness removal and readings at 15 minutes are taken as a measurement of "equilibrium" properties.

HZSC materials as well as reference materials are subjected to this test and the results are summarized as Table 1.

TABLE 1

Timed Hardness Removal by HZSC-type builders and some reference materials

| Sample HZSC Materials | Hardness Removed 15 seconds | Hardness Removed 15 Minutes | Synth. Ex. # |
|---|---|---|---|
| HZSC1* | 48% | 82% | 1 |
| HZSC2** | 43% | 51% | 2 |
| HZSC3* | 48% | 82% | 4 |

*gismondine-type hybrid with occluded silicate
**zeolite A-type hybrid with occluded silicate Reference Materials (See WO 98/42622)

| Reference Materials (See WO 98/42622) | | |
|---|---|---|
| Zeolite A | 10% | 41% |
| Zeolite MAP | 18% | 55% |
| COH | 6% | 48% |

Note with respect to percentage improvement levels discussed hereinabove. HZSC1 and HZSC3 have a 15-second hardness removal improvement, as compared with zeolite A, of ((48−10)/10)×100=380.0%. HZSC1 and HZSC3 have a 15-minute hardness removal improvement, as compared with zeolite A, of ((82−41)/41)×100=100.0%.

This test indicates that HZSC materials at 15 seconds are more rapid than the reference materials (conventional zeolites) and, at least in the case of HZSC having gismondine-type structure, have improved 15-minute removal data than the reference materials. Note, however, that if the HZSC materials have reduced crystal size relative to the reference materials, an improvement in 15 sec hardness removal is expected. Since, for the zeolite A-type HZSC, the 15-minute removal data is not substantially improved over the reference materials, this leaves some question as to the value of the overall water-softening improvement offered by the zeolite A-type HZSC. Such overall value is, however, not only a function of water softening in a simple test as given above, but also is dependent on the effective cleaning performance in a fully-formulated laundry detergent. This latter performance is affected by the presence of laundry detergent adjuncts. In short, the manufacturer of builder materials is in a position to suggest builder materials to be evaluated by the detergent formulator, but is not well-placed to accurately predict through simple tests which materials are most effective in practice.

Detergent Compositions

Detergent compositions of the present invention include a builder system that comprises, at least in part, the hybrid aluminosilicate as hereinbefore described, together with specified detergent adjuncts.

When the builder system does not differ from WO 98/42622, the present inventive detergent compositions are required to constitute a combination of a WO 98/42622 hybrid material and at least one selected detergent adjunct not disclosed or suggested in WO 98/42622. These selected adjuncts, especially advantageous in conjunction with hybrid builders, are described in detail hereinafter as "Class I detergent adjuncts".

When the builder system differs from one disclosed in WO 98/42622, more particularly, when the hybrid builder material is not one specifically disclosed in WO 98/42622, the present inventive detergent compositions comprise at least the hybrid builder material and one or more broadly defined detergent adjuncts. These more broadly defined detergent adjuncts can include any detergent adjunct or adjunct class disclosed in WO 98/42622 and the associated literature references, as well as any Class I detergent adjunct. Of course, preferred Class I adjuncts are included in all the preferred embodiments of all detergent compositions herein at levels of from about 0.0001% to about 99% of the detergent composition. Moreover, the preferred detergent compositions preferably include at least two Class I detergent adjuncts, more preferably at least three such adjuncts.

Preferred detergent compositions according to the invention may contain: (a) from 2 to 60 wt. % of one or more detergent surfactants, (b) from 10 to 80 wt. % of one or more detergency builders, including, the hybrid aluminosilicate, (c) from 5 to 40 wt. % of a bleach system, (d) from 0.05 to 10% of enzyme or mixtures thereof, and (e) optionally other detergent ingredients to 100 wt. %. Bleach-free embodiments are, of course, also contemplated.

Highly preferred detergent compositions herein comprise, in addition to (a) the hybrid builder, (b) from about 0.1% to about 99% of at least one detersive adjunct selected from the group consisting of: (i) detersive surfactants having at least one branched, preferably mid-chain branched hydrophobe; (ii) organic polymeric materials selected from polyacetal carboxylates, hydrophobically modified polyacrylates. terpolymers comprising acrylate or maleate, polymeric soil release agents, polymeric dye transfer inhibitors, polyamines, polyimines, polymeric rheology modifiers, and mixtures thereof; (iii) oxygen bleach promoting materials selected from hydrophobic bleach activators; organic bleach boosters; transition-metal bleach catalysts; phiotobleaches and mixtures thereof; (iv) fabric care promoting agents other than said organic polymeric materials; and (v) mixtures of (i)–(iv). Sources and examples of such materials have been given in the summary hereinabove.

Class I Detergent Adjuncts

Biodegradably Branched Surfactants

The present invention includes important embodiments comprising at least one biodegradably branched and/or crystallinity disrupted and/or mid-chain branched surfactant or surfactant mixture. The terms "biodegradably branched" and/or "crystallinity disrupted" and/or "mid-chain branched" (acronym "MCB" used hereinafter) indicate that such surfactants or surfactant mixtures are characterized by the presence of surfactant molecules having a moderately non-linear hydrophobe; more particularly, wherein the surfactant hydrophobe is not completely linear, on one hand, nor is it branched to an extent that would result in unacceptable biodegradation. The preferred biodegradably branched surfactants are distinct from the known commercial LAS, ABS, Exxal, Lial, etc. types, whether branched or unbranched. The biodegradably branched materials comprise particularly positioned light branching, for example from about one to about three methyl, and/or ethyl, and/or propyl or and/or butyl branches in the hydrophobe, wherein the branching is located remotely from the surfactant headgroup, preferably toward the middle of the hydrophobe. Typically from one to three such branches can be present on a single hydrophobe, preferably only one. Such biodegradably branched surfactants can have exclusively linear aliphatic hydrophobes, or the hydrophobes can include cycloaliphatic or aromatic substitution. Highly preferred are MCB analogs of common linear alkyl sulfate, linear alkyl poly(alkoxylate) and linear alkylbenzellesulfonate surfactants, said surfactant suitably being selected from mid-chain-$C_1$–$C_4$-branched $C_8$–$C_{18}$-alkyl sulfates, mid-chain-$C_1$–$C_4$-branched $C_8$–$C_{18}$-alkyl ethoxylated, propoxylated or butoxylated alcohols, mid-chain-$C_1$–$C_4$-branched $C_8$–$C_{18}$-alkyl ethoxysulfates, mid-chain-$C_1$–$C_4$-branched $C_8$–$C_{16}$-alkyl benzenesulfonates and mixtures thereof. When anionic, the surfactants can in general be in acid or salt, for example sodium, potassium, ammonium or substituted ammonium, form. The biodegradably branched surfactants offer substantial improvements in cleaning performance and/or usefulness in cold water and/or resistance to water hardness and/or economy of utilization. Such surfactants can, in general, belong to any known class of surfactants, e.g., anionic, nonionic, cationic, or zwitterionic. The biodegradably branched surfactants are synthesized through processes of Procter & Gamble, Shell, and Sasol. These surfactants are more fully disclosed in WO98/23712 A published Jun. 4, 1998; WO97/38957 A published Oct. 23, 1997; WO97/38956 A published Oct. 23, 1997; WO97/39091 A published Oct. 23, 1997; WO97,39089 A published Oct. 23, 1997; WO97/39088 A published Oct. 23, 1997; WO97/39087 A published Oct. 23, 1997; WO97/38972 A published Oct. 23, 1997; WO 98/23566 A Shell, published Jun. 4, 1998; technical bulletins of Sasol; and the following pending patent applications assigned to Procter & Gamble: [add complete list of pending cases]

Preferred biodegradably branched surfactants herein in more detail include MCB surfactants as disclosed in the following references:

WO98/23712 A published Jun. 4, 1998 includes disclosure of MCB nonionic surfactants including MCB primary alkyl polyoxyalkylenes of formula (1):

$CH_2CH_3(CH_2)_wC(R)H(CH_2)_xC(R^1)H(CH_2)_yC(R^2)H(CH_2)_z(EO/PO)_mOH$ (1), where the total number of carbon atoms in the branched primary alkyl moiety of this formula, including the R, $R^1$ and $R^2$ branching, but not including the carbon atoms in the EO/PO alkoxy moiety, is preferably 14–20, and wherein further for this surfactant mixture, the average total number of carbon atoms in the MCB primary alkyl hydrophobe moiety is preferably 14.5–17.5, more preferably 15–17; R, $R^1$ and $R^2$ are each independently selected from hydrogen and 1–3C alkyl, preferably methyl, provided R, $R^1$ and $R^2$ are not all hydrogen and, when z is 1, at least R or $R^1$ is not hydrogen; w is an integer of 0–13; x is an integer of 0–13; y is an integer of 0–13; z is an integer of at least 1; w+x+y+z is 8–14; and EO/PO are alkoxy moieties preferably selected from ethoxy, propoxy and mixed ethoxy/propoxy groups, where m is at least 1, preferably 3–30, more preferably 5–20, most preferably 5–15. Such MCB nonionics can alternately include butylene oxide derived moieties, and the —OH moiety can be replaced by any of the well-known end-capping moieties used for conventional nonionic surfactants.

WO97/38957 A published Oct. 23, 1997 includes disclosure of mid- to near-mid-chain branched alcohols of formulae $R—CH_2CH_2CH(Me)CH—R^1—CH_2OH$ (J) and $HOCH_2—R—CH_2—CH_2—CH(Me)—R^1$ (II) comprising: (A) dimerising alpha-olefins of formula $RCH{=}CH_2$ and $R^1CH{=}CH_2$ to form olefins of formula $R(CH_2)_2—C(R^1){=}CH_2$ and $R^1(CH_2)_2—C(R){=}CH_2$; (B) (i) isomerising the olefins and then reacting them with carbon monoxide/hydrogen under Oxo conditions or (ii) directly reacting the olefins from step (A) with $CO/H_2$ under Oxo conditions. In the above formulae, R, $R^1$=3–7C linear alkyl. WO97/38957 A also discloses (i) production of MCB alkyl sulphate surfactants by sulphating (I) or (II); (ii) preparation of MCB alkylethoxy sulphates which comprises ethoxylating and then sulphating (I) or (II); (iii) preparation of MCB alkyl carboxylate surfactants which comprises oxidising (I) or (II) or their aldehyde intermediates and (iv) preparation of MCB acyl taurate, MCB acyl isethionate, MCB acyl sarcosinate or MCB acyl N-methylglucamide surfactants using the branched alkyl carboxylates as feedstock.

WO97/38956 A published Oct. 23, 1997 discloses the preparation of mid- to near mid-chain branched alpha olefins which is effected by: (a) preparing a mixture of carbon monoxide and hydrogen; (b) reacting this mixture in the presence of a catalyst under Fischer-Tropsch conditions to prepare a hydrocarbon mixture comprising the described olefins; and (c) separating the olefins from the hydrocarbon mixture. WO97/38956 A further discloses the preparation of mid- to near mid-chain branched alcohols by reacting the olefins described with $CO/H_2$ under Oxo conditions. These alcohols can be used to prepare (1) MCB sulphate surfactants by sulphating the alcohols; (2) MCB alkyl ethoxy sulphates by ethoxylating, then sulphating, the alcohols; or (3) branched alkyl carboxylate surfactants by oxidising the alcohols or their aldehyde intermediates. The branched carboxylates formed can be used as a feedstock to prepare branched acyl taurate, acyl isethionate, acyl sarcosinate or acyl N-methylglucamide surfactants, etc.

WO97/39091 A published Oct. 23, 1997 includes disclosure of a detergent surfactant composition comprising at least 0.5 (especially 5, more especially 10, most especially 20) wt. % of longer alkyl chain, MCB surfactant of formula (I). A-X-B (I) wherein A is a 9–22 (especially 12–18) C MCB alkyl hydrophobe having: (i) a longest linear C chain attached to the X-B moiety of 8–21C atoms; (ii) 1–3C alkyl moiety(s) branching from this longest linear chain; (iii) at least one of the branching alkyl moieties attached directly to a C of the longest linear C chain at a position within the range of position 2 C, counting from C 1 which is attached to the CHUB moiety, to the omega-2 carbon (the terminal C minus 2C); and (iv) the surfactant composition has an average total number of C atoms in the A-X moiety of 14.5–17.5 (especially 15–17); and B is a hydrophilic (surfactant head-group) moiety preferably selected from sulfates, sulfonates, polyoxyalkylene (especially polyoxyethylene or polyoxypropylene), alkoxylated sulphates, polyhydroxy moieties, phosphate esters, glycerol sulphonates, polygluconates, polyphosphate esters, phosphonates, sulphosuccinates, sulphosuccinates, polyalkoxylated carboxylates, glucamides, taurinates, sarcosinates, plycinates, isethionates, mono-/di-alkanol-amides, monoalkanolamide sulphates, diglycol-amide and their sulphates, glyceryl esters and their sulphates, glycerol ethers and their sulphates, polyglycerol ether and their sulphates, sorbitan esters, polyalkoxylated sorbitan esters, ammonio-alkanesulphonates, amidopropyl betaines, alkylated quat, alkylated/poly-hydroxyalkylated (oxypropyl) quat., imidazolines, 2-yl succinates, sulphonated alkyl esters and sulphonated fatty acids; and X— is —$CH_2$— or —C(O)—. WO97/39091 A also discloses a laundry detergent or other cleaning composition comprising: (a) 0.001–99% of detergent surfactant (I); and (b) 1–99.999% of adjunct ingredients.

WO97/39089 A published Oct. 23, 1997 includes disclosure of liquid cleanings compositions comprising: (a) as part of surfactant system 0.1–50 (especially 1–40) wt % of a mid-chain branched surfactant of formula (I); (b) as the other part of the surfactant system 0.1–50 wt % of co-surfactant(s); (c) 1–99.7 wt % of a solvent; and (d) 0.1–75 wt % of adjunct ingredients. Formula (I) is A—$CH_2$—B wherein A=9–22 (especially 12–18) C MCB alkyl hydrophobe having: (i) a longest linear C chain attached to the X-B moiety of 8–21C atoms; (ii) 1–3C alkyl moiety(s) branching from this longest linear chain; (iii) at least one of the branching alkyl moieties attached directly to a C of the longest linear C chain at a position within the range of position 2 C, counting from Carbon No. 1 which is attached to the $CH_2B$ moiety, to the omega-2 carbon (the terminal C minus 2C); and (iv) the surfactant composition has an average total number of C atoms in the A-X moiety of 14.5–17.5 (especially 15–17): and B is a hydrophilic moiety selected from sulphates, polyoxyalkylene (especially polyoxyethylene and polyoxypropylene) and alkoxylated sulphates.

WO97/39088 A published Oct. 23, 1997 includes disclosure of a surfactant composition comprising 0.001–100% of MCB primary alkyl alkoxylated sulphate(s) of formula (I):

$CH_3CH_2(CH)_wCHR(CH_2)_xCHR^1(CH_2)_yCHR^2(CH_2)_2OSO_3M$ (I) wherein the total number of C atoms in compound (I) including R, $R^1$ and $R^2$, is preferably 14–20 and the total number of C atoms in the branched alkyl moieties preferably averages 14.5–17.5 (especially 15–17); R, $R^1$ and $R^2$ are selected from H and 1–3C alkyl (especially Me) provided R, $R^1$ and $R^2$ are not all H; when z=1 at least R or $R^1$ is not H; M are cations especially selected from Na, K, Ca, Mn, quaternar alkyl ammonium of formula $N^2R^3R^4R^5R^6$ (II); M is especially Na and/or K; $R^3$, $R^4$, $R^5$, $R^6$ are selected from H, 1–22C alkylene, 4–22C branched alkylene, 1–6C alkanol, 1–22C alkenylene, and/or 4–22C branched alkenylene; w, x, y=0–13; z is at least 1; w+x+v+z=8–14. WO97/39088 A also discloses (1) a surfactant composition comprising a mixture of branched primary alkyl sulphates of formula (I) as above. M is a water-soluble cation: When $R^2$ is 1–3C alkyl, the ratio of surfactants having z=1 to surfactants having z=2 or greater is preferably at least 1:1 (most especially 1:100); (2) a detergent composition comprising: (a) 0.001–99% of MCB primary alkyl alkoxylated sulphate of formula (III) and/or (IV). $CH_3(CH_2)_aCH(CH_3)(CH_2)_bCH_2OSO_3M$ (III)

$CH_3(CH_2)_dCH(CH_3)(CH_2)_eCH(CH_3)CH_2OSO_3M$ (IV) wherein a, b, d, and e are integers, preferably a+b=1(0–16 d+e=8–14 and when a+b=10, a=2–9 and b=1–8; when a+b=11, a=2–10 and b=1–9; when a+b=12, a=2–11 and b=1–10; when a+b=13, a=2–12 and b=1–12; when a+b=14, a=2–13 and b=1–12; when a+B=15, a=2–14 and b=1–13; when a+b=16, a=2–14 and b=1–14; when d+e=8, d=2–7 and e=1–6; when d+e=9, d=2–8 and e=1–7; when d+e=10, d=2–9 and e=1–8; when d+e=11, d=2–10 and e=1–9; when d+e=12, d=2–11 and e=1–10; when d+e=13, d=2–12 and e=1–11; when d+e=14, d=2–13 and c=1–12; and (b) 1–99.99 wt % of detergent adjuncts; (3) a mid-chain branched primary alkyl sulphate surfactant of formula(V):

$CH_3CH_2(CH_2)_xCHR^1(CH_2)_yCHR^2(CH_2)_zOSO_3M$ (V) wherein x, v=0–12; z is at least 2: x+y+z=11–14; $R^1$ and $R^2$ are not both H; when one of $R^1$ or $R^2$ is H, and the other is Me, x+y+z is not 12 or 13; and when $R^1$ is H and $R^2$ is Me, x+y is not 11 when z=3 and x+y is not 9 when z=5; (4) Alkyl sulphates of formula (III) in which a and b are integers and a=b=12 or 13, a=2–11, b=1–10 and M is Na, K, and optionally substituted ammonium; (5) alkyl sulphates of formula (IV) in which d and e are integers and d=e is 10 or 11 and when d=e is 10, d=2–9 and e=1–8; when d=e=11, d=2–10 and e=1–9 and m is Na, K, optionally substituted ammonium (especially Na); (6) methyl branched primary alkyl sulphates selected from 3-, 4-, 5-, 6-, 7-, 8-, 9-, 10-, 11-, 12-methyl pentadecanol sulphate; 3-, 4-, 5-, 6-, 7-, 8-, 9-, 10-, 11-, 12-, 13-, or 14-methyl hexadecanol sulphate; 2,3-, 2,4-, 2,5-, 2,6-, 2,7-, 2,8-, 2,9-, 2,10-, 2,11-, 2,12-methyl tetradecanol sulphate; 2,3-, 2,4-, 2,5-, 2,6-, 2,7-, 2,8-, 2,9-, 2,10-, 2,11-, 2,12-, or 2,13-methyl pentadecanol sulphate and/or mixtures of these compounds.

WO97/39087 A published Oct. 23, 1997 includes disclosure of a surfactant composition comprising 0.001–100% of mid-chain branched primary alkyl alkoxylated sulphate(s) of formula (I) wherein that total number of C atoms in compound (I) including R, $R^1$ and $R^2$, but not including C atoms of EO/PO alkoxy moieties is 14–20 and the total number of C atoms in branched alkyl moieties averages 14.5–17.5 (especially 15–17): R, $R^1$ and $R^2$ =H or 1–3C alkyl (especially Me) and R, $R^1$ and $R^2$ are not all H; when z=1 at least R or $R^1$ is not H; M=cations especially selected from Na, K, Ca, Mg, quaternary alkyl amines of formula (II) (M is especially Na and/or K) $R^3$, $R^4$, $R^5$, $R^6$=H, 1–22C alkylene, 4–22C branched alklyene, 1–6C alkanol, 1–22C alkenylene, and/or 4–22C branched alkenylene; w, x, y=0–13; z is at least 1; w+x+y+z=8–14; EO/PO are alkoxy moieties, especially ethoxy and/or propoxy; m is at least 0.01, especially 0.1–30, more especially 0.5–10, most especially 1–5. Also disclosed are: (1) a surfactant composition comprising a mixture of branched primary alkyl alkoxylated sulphates of formula (I) When $R^2$=1–3C alkyl, the ratio of surfactants having z=2 or greater to surfactant having z=1 is at least 1:1, especially 1.5:1, more especially 3:1, most especially 4:1; (2) a detergent composition comprising: (a) 0.001–99% of mid-chain branched primary alkyl alkoxylated sulphate of formula (III) and/or (IV) M is as above; a, b, d, and e are integers, a+b=10–16, d+e=8–14 and when a+b=10, a=2–9 and b=1–8; when a+b=11, a=2–10 and b=1–9; when a+b=12, a=2–11 and b=1–10; when a+b=13, a=2–12 and b=1–11; when a+b=14, a=2–13 and b=1–12; when a+b=15, a=2–14 and b=1–13; when a+b=16, a=2–14 and b=1–14; when d+e=8, d=2–7 and e=1–6; when d+e=9, d=2–8 and e=1–7; when d+e=10, d=2–9 and e=1–8; when d+e=11, d=2–10 and e=1–9; when d+e=12, d=2–11 and e=1–10; when d+e=13, d=2–12 and e=1–11; when d+e=14, d=2–13 and e=1–12; and (b) 1–99.99 wt % of detergent adjuncts; (3) a MCB primary alkyl alkoxylated sulphate surfactant of formula(V) R1, R2, M, EO/PO, m as above; x,y=0–12; z is at least 2; x+y+z=11–14; (4) a mid-chain branched alkyl alkoxylated sulphate of formula (III) in which: a=2–11; b=1–10; a+b=12 or 13; M, EO/PO and m are as above; (5) a mid-chain branched alkyl alkoxylated sulphate compound of formula (IV) in which: d+e=10 or 11;

when d+e=10, d=2–9 and e=1–8 and when d+e=11, d=2–10 and e=1–9: M is as above (especially Na); EO/PO and m are as above; and (6) methyl branched primary alkyl ethoxylated sulphates selected from 3-, 4- 5-, 6-, 7-, 8-, 9-, 10-, 11-, 12- or 13-methyl pentadecanol ethoxylated sulphate; 3-, 4-, 5-, 6-, 7-, 8-, 9-, 10-, 11-, 12-, 13-, or 14-methyl hexadecanol ethoxylated sulphate; 2,3-, 2,4-, 2,5-, 2,6-, 2,7-, 2,8-, 2,9-, 2,10-, 2,11-, 2,12-methyl tetradecanol ethoxylated sulphate; 2,3-, 2,4-, 2,5-, 2,6-, 2,7-, 2,8-, 2,9-, 2,10-, 2,11-, 2,12-, or 2,13-methyl pentadecanol ethoxylated sulphate and/or mixtures of these compounds. The compounds are ethoxylated with average degree of ethoxylation of 0.1–10.

WO97/38972 A published Oct. 23, 1997 includes disclosure of a method for manufacturing longer chain alkyl sulphate surfactant mixture compositions comprising (a) sulphating with $SO_3$, preferably in a falling film reactor, a long chain aliphatic alcohol mixture having an average carbon chain length of at least 14.5–17.5, the alcohol mixture comprising at least 10%, preferably at least 25%, more preferably at least 50% still more preferably at least 75%, most preferably at least 95% of a MCB aliphatic alcohol having formula (I); where: R, $R^1$, $R^2$=H or 1–3C alkyl, preferably methyl, provided R, $R^1$ and $R^2$ are not all H, and when z=1, at least R or $R^1$ is not H; w,x,y=integers 0–13; z=integer of at least 1: and w+x+y+z=8–14; where the total number of carbon atoms in the branched primary, alkyl moiety of formula (I), including the R, $R^1$ and $R^2$ branching, is 14–20, and where further for the alcohol mixture the average total number of carbon atoms in the branched primary alkyl moieties having formula (I) is >14.5–17.5, preferably, >15–17; and (b) neutralising the alkyl sulphate acid produced by step (a), preferably using a base selected from KOH, NaOH, ammonia, monoethanolamine, triethanolamine and mixtures of these. Also disclosed is a method for manufacturing longer chain alkyl alkoxylated sulphate surfactant mixture compositions, comprising alkoxylating the specified long chain aliphatic alcohol mixture; sulphating the resulting polyoxyalkylene alcohol with $SO_3$; and neutralising(the resulting alkyl alkoxylate sulphate acid. Alternatively, the alkyl alkoxylated sulphates may be produced directly from the polyoxyalkylene alcohol by sulphatina with $SO_3$ and neutralising.

WO 98/23566 A Shell, published Jun. 4, 1998 discloses branched primary alcohol compositions having 8–36 C atoms and an average number of branches per mol of 0.7–3 and comprising ethyl and methyl branches. Also disclosed are: (1) a branched primary alkoxylate composition preparable by reacting a branched primary alcohol composition as above with an oxirane compound; (2) a branched primary alcohol sulphate preparable by sulphating a primary alcohol composition as above; (3) a branched alkoxylated primary alcohol sulphate preparable by alkoxylating and sulphating a branched alcohol composition as above; (4) a branched primary alcohol carboxylate preparable by oxidising a branched primary alcohol composition as above; (5) a detergent composition comprising: (a) surfactant(s) selected from branched primary alcohol alkoxylates as in (1), branched primary alcohol sulphates as in (2), and branched alkoxylated primary alcohol sulphates as in (3); (b) a builder; and (c) optionally additive(s) selected from foam control agents, enzymes, bleaching agents, bleach activators, optical brighteners, co-builders, hydrotropes and stabilisers. The primary alcohol composition, and the sulphates, alkoxylates, alkoxy sulphates and carboxylates prepared from them exhibit good cold water detergency and biodegradability.

Biodegradably branched surfactants useful herein also include the modified alkylaromatic, especially modified alkylbenzenesulfonate surfactants described in copending commonly assigned patent applications [INSERT MLAS Case REFERENCES incl. 7303P, 7304P and the earlier filed MLAS cases]. In more detail, these surfactants include (P&G Case 6766P) alkylarylsulfonate surfactant systems comprising from about 10% to about 100% by weight of said surfactant system of two or more crystallinity-disrupted alkylarylsulfonate surfactants of formula $(B—Ar—D)_a$ $(M^{q+})_b$ wherein D is $SO_3$-, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms and one or more crystallinity-disrupting moieties wherein said crystallinity-disrupting moieties interrupt or branch from said hydrocarbyl moiety; and wherein said alkylarylsulfonate surfactant system has crystallinity disruption to the extent that its Sodium Critical Solubility Temperature, as measured by the CST Test, is no more than about 40° C. and wherein further said alkylarylsulfonate surfactant system has at least one of the following properties: percentage biodegradation, as measured by the modified SCAS test, that exceeds tetrapropylene benzene sulfonate, and weight ratio of nonquaternary to quaternary carbon atoms in B of at least about 5:1.

Such compositions also include (P&G Case 7303P) surfactant mixtures comprising (preferably, consisting essentially of): (a) from about 60% to about 95% by weight (preferably from about 65% to about 90%, more preferably from about 70% to about 85%) of a mixture of branched alkylbenizenesulfonates having formula (I):

(I)

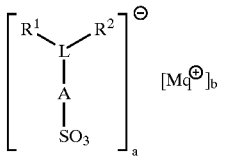

wherein L is an acyclic aliphatic moiety consisting of carbon and hydrogen and having two methyl termini, and wherein said mixture of branched alkylbenzenesulfonates contains two or more (preferably at least three, optionally more) of said compounds differing in molecular weight of the anion of said formula (I) and wherein said mixture of branched alkylbenzenesulfonates is characterized by an average carbon content of from about 10.0 to about 14.0 carbon atoms (preferably from about 11.0 to about 13.0, more preferably from about 11.5 to about 12.5), wherein said average carbon content is based on the sum of carbon atoms in $R^1$, L and $R^2$, (preferably said sum of carbon atoms in $R^1$, L and $R^2$ is from 9 to 15, more preferably, 10 to 14) and further, wherein L has no substituents other than A, $R^1$ and $R^2$; M is a cation or cation mixture (preferably selected from H, Na, K, Ca, Mg and mixtures thereof, more preferably selected from H, Na, K and mixtures thereof, more preferably still, selected from H, Na, and mixtures thereof) having a valence q (typically from 1 to 2, preferably 1); a and b are integers selected such that said compounds are electroneutral (a is typically from 1 to 2, preferably 1, b is 1); $R^1$ is $C_1$–$C_3$ alkyl (preferably $C_1$–$C_2$ alkyl, more preferably methyl); $R^2$ is selected from H and $C_1$–$C_3$ alkyl (preferably H and $C_1$–$C_2$ alkyl, more preferably H and methyl, more preferably H and methyl provided that in at least about 0.5, more preferably 0.7, more preferably 0.9 to 1.0 mole fraction of said branched alkylbenzenesulfonates $R^2$ is H); A is a benzene moiety (typically A is the moiety —$C_6H_4$—, with the $SO_3$ moiety of Formula (I) in para-position to the L moiety, though in some proportion, usually no more than about 5%, preferably from 0 to 5% by weight, the $SO_3$ moiety is ortho- to L); and (b) from about 5% to about 60% by weight (preferably from about 10% to about 35%, more preferably from about 15% to about 30%) of a mixture of nonbranched alkylbenzenesulfonates having formula (II):

(II)

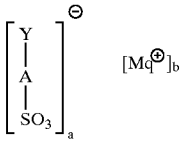

wherein a, b, M, A and q are as defined hereinbefore and Y is an unsubstituted linear aliphatic moiety consisting of carbon and hydrogen having two methyl termini, and wherein Y has an average carbon content of from about 10.0 to about 14.0 (preferably from about 11.0 to about 13.0, more preferably 11.5 to 12.5 carbon atoms); (preferably said mixture of nonbranched alkylbenzenesulfonates is further characterized by a sum of carbon atoms in Y, of from 9 to 15, more preferably 10 to 14); and wherein said composition is further characterized by a 2/3-phenyl index of from about 350 to about 10,000 (preferably from about 400 to about 1200, more preferably from about 500 to about 700) (and also preferably wherein said surfactant mixture has a 2-methyl-2-phenyl index of less than about 0.3, preferably less than about 0.2, more preferably less than about 0.1, more preferably still, from 0 to 0.05).

Also encompassed by way of mid-chain branched surfactants of the alkylbenzene-derived types are surfactant mixtures comprising the product of a process comprising the steps of: alkylating benzene with an alkylating mixture; sulfonating the product of (I); and neutralizing the product of (II); wherein said alkylating mixture comprises: (a) from about 1% to about 99.9%, by weight of branched $C_7$–$C_{20}$ monoolefins, said branched monoolefins having structures identical with those of the branched monoolefins formed by dehydrogenating branched parafins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_7$–$C_{20}$ linear aliphatic olefins; wherein said alkylating mixture contains said branched $C_7$–$C_{20}$ monoolefins having at least two different carbon numbers in said $C_7$–$C_{20}$ range and has a mean carbon content of from about 9.5 to about 14.5 carbon atoms; and wherein said components (a) and (b) are at a weight ratio of at least about 15:85.

Selected Cationic Surfactants

Preferred detergent compositions herein also include those wherein the hybrid builder material of WO 98/42622, or a different hybrid builder as disclosed herein, are combined with selected cationic surfactants. These selected cationic surfactants include:

(i) cationic surfactants having one long chain and three relatively short chains in which one or more substituents attached to the nitrogen atom contain oxygen, as for example in hydroxyethyl, and/or in which the relatively long chain is branched. Such surfactants include, for example, compounds having the formula $R^1N^+R^2R^3R^4X^-$ wherein $R^1$ is $C_8$–$C_{16}$ linear or branched alkyl (optionally including one or more aryl, ether or ester moieties) and wherein $R^2$–$R^4$ can vary independently and can, for example, comprise methyl, ethyl, propyl, butyl, hydroxyethyl, hydroxypropyl and mixtures thereof provided that at least one of $R^2$–$R^4$ is hydroxyalkyl, preferably hydroxyethyl, $X^-$ is any compatible anion, for example one selected from halogen, (e.g, chloride, bromide), acetate, citrate, lactate, glycolate, phosphate nitrate, sulfate, and alklysulfate. Mixtures of these compounds and the corresponding anions can be used; and/or (ii) cationic surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion, for example chloride and/or cationic surfactants other than the conventional alkyltrimethylammonium salts corresponding to the general formula:

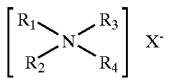

wherein $R_1$, $R_2$, $R_3$, and $R_4$ are independently selected from an aliphatic group of from 1 to about 22 carbon atoms or an aromatic, alkoxy, polyoxyalkylene, alkylamido, hydroxyalkyl, aryl or alkylaryl group having up to about 22 carbon atoms; and X is a salt-forming anion such as those selected from halogen; (e.g. chloride, bromide), acetate, citrate, lactate, glycolate, phosphate nitrate, sulfate, and alkylsulfate radicals; wherein said compounds the aliphatic groups contain, in addition to carbon and hydrogen atoms, other linkages such as ether linkages, and/or other groups such as amino groups. The longer chain aliphatic groups, e.g., those of about 12 carbons, or higher, can be saturated or unsaturated. Preferred is when $R_1$, $R_2$, $R_3$, and $R_4$ are independently selected from C1 to about C22 alkyl. Especially preferred for some purposes are cationic materials containing two long alkyl chains and two short alkyl chains or those containing one long alkyl chain and three short alkyl chains other than methyl. The long alkyl chains in the compounds described in the previous sentence have from about 8 to about 22 carbon atoms, preferably from about 10 to about 14 carbon atoms.

Also useful herein are the bis- alkoxylated quaternary ammonium (bis-AQA) surfactants and combinations including same disclosed in WO9744433 A1, WO9744431 A1, WO9744432 A1, WO9743394 A, WO9743393 A, WO9743391 A, WO9743390 A, WO9743389 A, WO9743371 A, WO9744420 A, WO9744419 A, WO9744418 A, WO9743388 A, WO9743387 A, WO9743365 A, WO9743364 A. See also WO9738968 A1.

The selected cationic surfactants can be used herein for one or more purposes, including net contribution to cleaning, especially of greasy soils, or for other purposes, such as softening through the wash and/or for antimicrobial purposes.

Suitable levels of these cationic surfactants herein are from about 0.1% to about 20%, preferably from about 1% to about 15%, although much higher levels, e.g., up to about 30% or more, man be useful especially in nonionic: cationic (i.e., limited or anionic-free) formulations. Highly preferred compositions however combine the cationic surfactant at a very low level, e.g., from about 0.1% to about 5%, preferably not more than about 2%, with the HZSC materials. The selected cationic surfactants, even at said low levels, are surprisingly effective with the HZSC builder materials.

Conventional, especially alkyltrimethylammonium cationic surfactants can be used in conjunction with the selected cationic surfactant types if desired.

Selected Sugar-derived Surfactants

Preferred detergent compositions herein also include those wherein the hybrid builder material of WO 98/42622 or a different hybrid builder as disclosed herein is combined with selected sugar-derived surfactants. These selected sugar-derived surfactants include in particular the $C_1$–$C_{16}$ alkyl N-methyl glucamides, for example as disclosed in WO 92/06070 A or WO 92/05071 A published Apr. 16, 1992; any of the known lactobionamide surfactants, and combinations of the glucosamides and/or lactobionamides with alkylpolyglucosides (APG's).

Cationic-Anionic Ion Pair Surfactants

U.S. Pat. No. 5,472,455 discloses water-soluble complexes of anionic and cationic surfactants. These are useful in conjunction with hybrid builders.

Bleach

Preferred detergent compositions of the invention include those combining HZSC or hybrid builders with selected bleach or bleach-forming materials.

Transition-metal Bleach Catalysts

These selected materials include one or more transition-metal-containing bleach catalysts such as the materials described in WO 98/39406 A, WO 98/39405 A, WO 98/39335 A, for example those more specifically illustrated hereinafter—see also WO 97/00937, WO 96/06155, EP 718398 A, U.S. Pat. No. 5,720,897 and WO 97/48787.

Particularly preferred are iron- or manganese containing bleach catalysts. Even more highly preferred are transition-metal bleach catalysts based on any rigid macropolycyclic ligand, for example any mononuclear or dinuclear transition metal complex based on triazacyclononane, more preferably monometallic catalysts wherein the rigid macropolycyclic ligand is cross-bridged, as in Bcyclam or any of its homologs, for example those in which terminal alkyl moieties connected to nitrogen are selected from methyl, ethyl and mixtures thereof. A particularly useful transition-metal bleach catalyst wherein the terminal alkyl moieties connected to nitrogen are methyl is [Mn(Bcyclam)Cl2]:

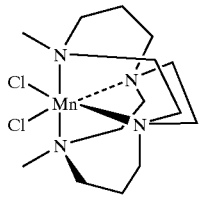

"Bcyclam" (5,12-dimethyl-1,5,8,12-tetraaza-bicyclo[6,6,2]hexadecane) is prepared according to J. Amer. Chem. Soc., (1990), 112, 8604. Bcyclam (1.00 g., 3.93 mmol) is dissolved in dry $CH_3CN$ (35 mL, distilled from $CaH_2$). The solution is evacuated at 15 mm until the CHICN begins to boil. The flask is then brought to atmospheric pressure with Ar. This degassing procedure is repeated 4 times. $Mn(pyridine)_2Cl_2$ (1.12 g., 3.93 mmol), synthesized according to the literature procedure of J. Inorg. Nucl. Chem., (1974), 36, 1535, is added under Ar and the mixture is stirred overnight at room temperature. The reaction solution is filtered with a 0.2$\mu$ filter. The filtrate is evaporated. 1.35 g. of product is collected, 90% yield. The amount of transition metal bleach catalyst when present in the detergent compositions of the invention is suitably from 0.0001% to 1 wt. %, more typically from 0.001% to about 0.1%.

Organic Bleach Catalysts

The selected bleach-promoting materials also include organic bleach catalysts or organic bleach boosters or so-called oxygen transfer agents, for example the N-acylimine types described in WO98/07825 A or the phosphinoyl imine types described in U.S. Pat. No. 5,652,207. Such materials also include sulfonimines. These materials are organic catalysts for bleaching, as distinct from the so-called bleach activators or bleach precursors such as TAED, which are stoichiometric, and not catalytic. Organic bleach catalysts include the compounds themselves and/or any of their precursors, for example any suitable ketone for production of dioxiranes and/or any of the hetero-atom containing analogs of dioxirane precursors or dioxiranes, such as sulfonimines and/or the imines described in U.S. Pat. No. 5,576,281 and references described therein. Organic bleach catalysts can, in general, include anionic, cationic, nonionic or zwitterionic types. Zwitterionic types are among the most preferred. Preferred organic bleach catalysts more particularly include omega-(3,4-dihydroisoquinolinium alkane sulfonates as in U.S. Pat. No. 5,576,282 and oxaziridines as described in U.S. Pat. No. 5,710,116. Levels can be, for example, from about 0.01% to about 5%.

Hydrophobic and Other Selected Bleach Activators and/or Precursors

Preferred detergent compositions herein include, in addition to a hybrid builder material, a hydrophobic peracid or an activator capable of releasing such peracid. The hydrophobic types include those containing a chain of six or more carbon atoms, preferred hydrophobic types having a linear aliphatic C8–C14 chain optionally substituted by one or more ether oxygen atoms and/or one or more aromatic moieties, preferably positioned such that the peracid is an aliphatic peracid. More generally, such optional substitution by ether oxygen atoms and/or aromatic moieties can be applied to any of the peracids or bleach activators herein. Branched-chain peracid types and aromatic peracids having one or more C3–C16 linear or branched long-chain substituents can also be useful. The peracids can be used in the acid form or as any suitable salt with a bleach-stable cation.

Especially useful herein are the organic percarboxylic acids of formula:

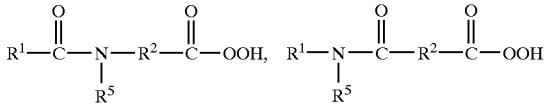

or mixtures thereof wherein $R^1$ is alkyl, aryl, or alkaryl containing from about 1 to about 14 carbon atoms. $R^2$ is alkylene, arylene or alkarylene containing from about 1 to about 14 carbon atoms, and $R^3$ is H or alkyl, aryl, or alkaryl containing from about 1 to about 10 carbon atoms. When these peracids have a sum of carbon atoms in $R^1$ and $R^2$ together of about 6 or higher, preferably from about 8 to about 14, they are particularly suitable as hydrophobic peracids for bleaching a variety of relatively hydrophobic or "lipophilic" stains, including so-called "dingy" types. Calcium, magnesium, or substituted ammonium salts may also be useful. With respect to any of these peracids, a bleach activator which yields the corresponding peracid under perhydrolysis conditions can desirably be used. The bleach activator will generally have a leaving group having any suitable $pK_a$ for perhydrolysis in-use. The $pK_a$ of the conjugate acid of the leaving group is a measure of suitability, and is typically from about 4 to about 16, or higher, preferably from about 6 to about 12, more preferably from about 8 to about 11. Common leaving groups include oxybenzenesulfonate. Most commonly, when peracetic acid is the desired peracid, the bleach activator or precursor is an acethylated diamine, such as tetracetylethylenediamine (TAED).

Other useful hydrophobic bleach activators or the corresponding peracids useful herein are acetylenic materials such as undec-10-ynoyl-oxy-benzene sulphonic acid or related activators as disclosed in DE19616782 A1.

Another useful bleach material, whether in the preacid, bleach activator, or diacyl peroxide form, derives from phthalimido- substituted materials such as phthalimidopercaproic acid or 6-phthalimidohexaneperoxoic acid (CAS Registry Number 128275-31-0), for example as disclosed in U.S. Pat. No. 5,487,818, U.S. Pat. No. 5,415,796, EP 852, 259 A, and WO 98/39405 A though other phthalimido-substituted bleach promoting materials, for example those of EP 780,374 A or EP 325,288 A, can also be used. Yet another useful hydrophobic bleach activator and/or the corresponding peracid are disclosed in U.S. Pat. No. 5,061,807, DE 3823172 A, and Japanese Laid-open patent application (Kokai) No. 4-28799. The peracid is preferably 3-dodecyl-, 5-dioxo-1-pyrrolidine hexaneperoxoic acid. Analogs varying in length of the longest chain from $C_8$–$C_{16}$, as well as branched analogs, other related imidoperoxycarboxyile acids as disclosed in U.S. Pat. No. 5,061,807, and any of the corresponding activators with any known leaving-group are equally applicable herein.

More particularly preferred hydrophobic bleach activators include sodium nonanoyloxybenzene sulfonate (NOBS or SNOBS), substituted amide types, and the above-identified activators related to certain imidoperacid bleaches, for example as described in U.S. Pat. No. 5,061,807. Also useful are the acyl lactam activators especially the acyl caprolactams (e.g. WO 94-28102 A), acyl valerolactams (e.g. U.S. Pat. No. 5,503,639), and certain N(alkanoyl) amino alkanoyloxybenzene sulfonates as described in WO 98/27056 A.

The diacyl peroxides corresponding to any of the above-identified peracids and/or activators are also encompassed herein.

Also useful herein as activators are compounds that, under perhydrolysis conditions, release (i) percarboxyilc acids and (ii) labile groups that can act as a substrate for enzymes, especially redox-active enzymes. See DE19713852 A.

Combinations of the above-identified peracids and/or bleach activators are also especially useful. Moreover, combinations of the above-identified peracids and/or activators with conventional bleach activators, especially TAED, can give very good combinations of dings and hydrophilic stain removal.

Bleach activators are suitably used in amounts of from 1 to 8 wt. %, preferably from 2 to 5 wt. %.

Photobleaches

The present invention encompasses combinations of the hereinabove-defined hybrid builder materials with photobleaches. In general, any photobleach can be used, such as the fully or partially sulfonated zinc and/or aluminium phthalocyanines; see for example BE-865371 A, GB 1408144 A, U.S. Pat. No. 4,497,741, RD 182041 or EP 119,746. Other photobleaches suitable for use herein are any of those commercially available from CIBA. However preferred photobleaches useful herein in particular include Si-phthalocyanines as disclosed in WO 97/05202 A, low-hue photobleaches as described in WO 98/32832 A and U.S. Pat. No. 5,679,661, superoxide-generating photobleaches as described in WO 98/32829 A, singlet oxygen generating photobleaches as described in WO 98/32828 A, and other photobleaches as described in WO 98/32827 A, WO 98/32826 A, WO 98/32825 A and WO 98/32824 A. Photobleaches can be used singly or in combination. Type and amount of hue can be adjusted according to the desires of the formulator.

Bleach-promoting Enzymes

The present invention encompasses combinations of the hereinabove-defined hybrid builder materials with bleach-promoting enzymes. Bleach-promoting enzymes in general include any enzymes having bleach-promoting action via oxidation or reduction of colored soils and/or stains. The term "bleach-promoting enzymes" includes live natural or genetic-engineered enzymes having a bleach-promoting function with or without there being a requirement for addition of any other redox-active or bleaching material. Moreover the term "bleach-promoting enzymes" encompasses the enzymes themselves and any related polypeptides having similar effect. Suitable bleach-promoting enzymes herein include oxidoreductases. More particular bleach-promoting enzymes include oxidases or combination systems including same (DE19523389 A1), mutant blue copper oxidases (WO9709431 A1), peroxidases (see for example U.S. Pat. No. 5,605,832, WO97/31090 A1), mannanases (WO9711164 A1); laccases, see WO9838287 A1 or WO9838286 A1 or for example, those laccase variants having amino acid changes in myceliophthora or scytalidium laccase(s) as described in WO9827197 A1 or mediated laccase systems as described in DE19612193 A1), or those derived from coprinus strains (see, for example WO9810060 A1 or WO9827198 A1), phenol oxidase or polyphenol oxidase (JP10174583 A) or mediated phenol oxidase systems (WO9711217 A); enhanced phenol oxidase systems (WO 9725468 A WO9725469 A); phenol oxidases fused to an aminoacid sequence having a cellulose binding domain (WO9740127 A1, WO9740229 A1) or other phenol oxidases (WO9708325 A, WO9728257 A1) or superoxide dismutases Oxidoreductases and/or their associated antibodies can be used, for example with $H_2O_2$, as taught in WO 98/07816 A. Depending on the type of deterrent composition, other redox-active enzymes can be used, even, for example, catalases (see, for example JP09316490 A). The bleach-promoting enzymes can be coated (see for example WO9731088 A1) or uncoated.

Also useful herein are combinations of the hybrid builder with any oxygenase of extracellular origin, especially fungal oxygenase such as dioxygenase of extracellular origin. The latter is most especially quercetinase, catechinase or an anthocyanase, optionally in combination with other suitable oxidase, peroxidase or hydrolytic enzymes, all taught in WO9828400 A2.

Enzyme compositions herein can be solid or liquid, aqueous or non-aqueous and include a substantially water-free liquid composition comprising (A) an enzyme; (B) a substance selected from (i) substances which in aqueous medium are precursors for substrates for the enzyme; and (ii) substances which are cofactors for the enzyme; and (C) a non-aqueous liquid phase as described in WO9741215 A1.

Preferred bleach-promoting enzyme systems include systems which generate hydrogen peroxide in-situ, for example glucose oxidases or glucose oxidase-like polypeptides as taught in WO9820136 A1; or an enzyme having aminoalcohol- or D-aminoacid-oxidase activity and a substrate for this enzyme as described in DE19545729 A1.

Other useful bleach-promoting enzyme systems useful herein incorporate lipoxygenase enzyme, unsaturated acid and a transition metal ion as described in DK9800352 A. In a preferred mode, the lipogygenase or other suitable bleach-promoting enzyme is combined with the transition metal bleach catalysts taught elsewhere herein.

Still further useful detergent compositions herein are those one-part or multi-part compositions or wash media comprising the hybrid builder materials together with bleach-promoting enzyme systems comprising chloroperoxidase, a hydrogen peroxide source, chloride and adhering agent, preferably formed at or near the site of use, as described in WO 98/42370 A.

Other bleach-promoting enzyme related systems useful herein include those of WO 9807824 A and WO9807816 A1 which disclose a detergent composition comprising a source of hydrogen peroxide and a donor-hydrogen peroxide oxidoreductase-directed antibody.

Builder

The present invention also encompasses combinations of the hereinabove-defined hybrid builder materials with specific inorganic builders, more particularly one or more of the following materials.

Crystalline Silicates

Specific crystalline silicates especially useful herein include a foliated crystalline sodium silicate with high delta-phase fraction as disclosed in EP-860398 A1; DE19707449 C1; particular layered or sheet silicates as disclosed in JP09025116; JP10007416 A; WO9703018 A1; DE19613060 A1; EP-753568 A; EP-745559 A1; U.S. Pat. No. 5,567,404 A; EP-731058 A1, crystalline sodium silicate having delta, alpha, beta- and/or NS-phase as disclosed in WO9719156 A1; other crystalline silicates as disclosed in WO9716525 A1; JP08311494 A; JP08311493 A; JP08268708 A; crystalline silicates made by sintering amorphous silicates as disclosed in JP09183611 A; crystalline disilicates as disclosed in DE4439083 A1; crystalline silicate powders with RUB-18 structure and specified X-ray diffraction pattern as disclosed in EP-775670 A1; anhydrous crystalline silicates, especially containing, potassium as disclosed in WO 98/31631 A1, JP09302384 A; and metasilicate pentahydrate as disclosed in CN1131125 A.

Amorphous Silicates

Specific amorphous sodium silicates useful herein include sodium silicate-metal sulphate composite powders containing the metal sulphate as a solid solution as disclosed in EP-728837 A1; amorphous ammonium and alkali silicate granules as disclosed in IT1265262 B; X-ray amorphous sodium silicate with low crystallisation temperatures prepared from amorphous silicate with higher water content that can be converted to beta- and alpha-modifications by microwave drying in stages, as disclosed in DE19710383 A1; other specific amorphous silicates as disclosed in DE19541755 A1; DE19525378 A1; WO96/28382 A; DE4446363 A1; DE4435632 A1; JP10007417 A; JP09309719 A; and crystalline/amorphous silicate combinations as disclosed in JP09087690 A, JP09067592 A.

Amorphous Aluminosilicates

Amorphous aluminosilicates useful herein include those of JP09202613 A; JP08333113 A.

Crystalline Aluminosilicates and/or Zeolites

Specific zeolite compositions useful herein in conjunction with the hybrid builder materials include P-type zeolites as disclosed in EP 758,626 A1; WO96/34828 A1; WO96/14270 A1; alkali metal silicates deposited onto P-type zeolites as disclosed in WO9734980 A1; gamma-irradiated zeolites as disclosed in CN1113263 A, or the equivalent material made without irradiation; alumino-silicates having primarily tetrahedrally coordinated aluminium, formed by the chemical modification of 2:1 layer clay minerals as disclosed in WO9618576 A1; zeolites prepared from aluminosilicate gels under pulsation as disclosed in RU2083493 C1; microporous zeolite A-LSX as disclosed in EP-816291 A1; zeolites grown with the assistance of microwave energy as disclosed in DE19548742 C1; and mechanically crushed zeolite A having particle size below 1 micron as disclosed in JP09067117 A.

Magnesiosilicates

Magnesiosilicates can be used in conjunction with the hybrid builders herein. These include the magnesiosilicate materials of WO 97/10179. In more detail, a highly preferred illustrative magnesiosilicate compound for use as a builder component with the hybrid builder materials herein is one having a calcium binding capacity (CBC) of at least 10 mg CaO per gram at room temperature, a magnesium binding capacity (MBC) of at least 10 mg MgO per gram at room temperature, and a calcium binding rate (CBR) of no more than 300 seconds at room temperature, being the time taken to remove half of the Ca2+ from a~100 ppm Ca2+ solution at a loading of 3g per liter, and having either a stuffed silica polymorph-related structure or a layered structure with a characteristic broad X-ray powder diffraction peak occurring at a d-spacing of between 11 and 17 A.

Seeded Builder Systems

Various seeded builder can be used in conjunction with the hybrid builder materials herein. These include sodium carbonate in combination with a crystallization seed for calcium carbonate, see GB 1 437 950; tabular calcium carbonates as disclosed in WO9840458 A1; rhombohedral calcium carbonates as disclosed in WO9840457 A1; WO9840456 A1; WO9840455 A1; see also builders with crystalline microstructure comprising carbonate WO9638526 A1; WO9733966 A1; WO9638525 A1; WO9638524 A1.

Other Inorganic Builders

Other inorganic builders especially useful in conjunction with the hybrid builders herein are noncaking silicates treated with organic compounds as disclosed in JP09208218 A; other new silicates as disclosed in JP10081509 A; compacted sodium silicates as disclosed in WO9717286 A1; trisodium phosphate hydrate as disclosed in WO9715527 A1; and an ion-capturing agent for alkaline earth metal ions which contains a precipitating agent for the ions within pores of a porous support. Preferably the support is silica gel. The pore diameter of the support is 0.3–15 nm. The precipitating agents comprise alkali metal carbonates, bicarbonates, silicates, sulphates and organic acid salts. This latter builder is as disclosed in JP09241680 A. Yet another useful inorganic builder contains alkaline retarding particles, surfactant and an ion blockade agent to elevate pH of washing water after lowering its hardness, as disclosed in WO9709414 A1.

Non-bleaching Enzymes

Enzymes other than generic proteases and amylases as referred to in WO 98/42622 can be used in conjunction with the hybrid builders to unexpectedly great advantage. Such enzymes include non-genenic proteases, non-generic amylases, non-bleaching enzymes other than proteases and/or amylases, bleaching enzymes, combinations thereof, combinations thereof with any suitable antibodies, inhibitors, stabilizers, or promoters; and combinations of any such non-generic enzymes and/or enzyme-specific adjuncts with generic proteases and/or amylases. Bleaching enzymes and adjuncts specific for use therewith, for formula accounting purposes, are accounted with the bleach system, as described elsewhere herein.

Preferred non-bleaching enzymes useful in conjunction with hybrid builder materials herein include enzymes derived from extremophiles, as well as hydrolases other than protease and/or amylase.

Preferred non-bleaching enzymes other than protease and/or amylase in particular can have low or even very high activity (EP 839,05 A), can include combinations of plant cell wall degrading enzymes and non-cell wall-degrading enzymes (WO 98/39403 A) and can, more specifically, include pectinase (WO 98/06808 A, JP10088472 A, JP10088485 A); pectolyase (WO98/06805 A1)); pectin lyases free from other pectic enzymes (WO9806807 A1); chondriotinase (EP 747,469 A); xylanase (EP 709,452 A, WO 98/39404 A, WO98/39402 A) including those derived from microlet) uspoia flexuosa (U.S. Pat. No. 5,683,911); isopeptidase (WO 98/16604 A); keratinase (EP 747,470 A, WO 98/40473 A); lipase (GB 2,297,979 A; WO 96/16153 A, WO 96/12004 A; EP 698,659 A; WO 96/16154 A); cellulase or endoglucanase (GB 2,294.269 A; WO 96/27649 A; GB 2,303,147 A; WO98/03640 A; see also neutral or alkaline cellulases derived from *chrysosporium lucknowense* strain VKM F-3500D as disclosed in WO9815633 A); polygalacturonase (WO 98/06809 A); mycodextranase (WO 98/13457 A); thermitase (WO 96/28558 A); cholesterol esterase (WO 98 28394 A); or any combination thereof.

Preferred proteases useful herein include certain variants (WO 96/28566 A; WO 96/28557 A; WO 96/28556 A; WO 96/25489 A).

Other particularly useful proteases are multiply-substituted protease variants comprising, a substitution of an amino acid residue with another naturally occurring amino acid residue at an amino acid residue position corresponding to position 103 of *Bacillus amyloliquefaciens* subtilisin in combination with a substitution of an amino acid residue with another naturally occurring amino acid residue at one or more amino acid residue positions corresponding to positions 1, 3, 4, 8, 9, 10, 12, 13, 16, 17, 18, 19, 20, 21, 22, 24, 27, 33, 37, 38, 42, 43, 48, 55, 57, 58, 61, 62, 68, 72, 75, 76, 77, 78, 79, 86, 87, 89, 97, 98, 99, 101, 102, 104, 106, 107, 109, 111, 114, 116, 117, 119, 121, 123, 126, 128, 130, 131, 133, 134, 137, 140, 141, 142, 146, 147, 158, 159, 160, 166, 167, 170, 173, 174, 177, 181, 182, 183, 184, 185, 188, 192, 194, 198, 203, 204, 205, 206, 209, 210, 211, 212, 213, 214, 215, 216, 217, 218, 222, 224, 227, 228, 230, 232, 236, 237, 238, 240, 242, 243, 244, 245, 246, 247, 248, 249, 251, 252, 253, 254, 255, 256, 257, 258, 259, 260, 261, 262, 263, 265, 268, 269, 270, 271, 272, 274 and 275 of *Bacillus amyloliquefaciens* subtilisin: wherein when said protease variant includes a substitution of amino acid residues at positions corresponding to positions 103 and 76, there is also a substitution of an amino acid residue at one or more amino acid residue positions other than amino acid residue positions corresponding to positions 27, 99, 101, 104, 107, 109, 123, 128, 166, 204, 206, 210, 216, 217, 218, 222, 260, 265 or 274 of *Bacillus amyloliquefaciens* subtilisin and/or multiply-substituted protease variants comprising a substitution of an amino acid residue with another naturally occurring amino acid residue at one or more amino acid residue positions corresponding to positions 62, 212, 230, 232, 252 and 257 of *Bacillus amyloliquefaciens* subtilisin as described in PCT Application Nos. PCT/US98/22588, PCT/US98/22482 and PCT/US98/22486 all filed on Oct. 23, 1998 from The Procter & Gamble Company (P&G Cases 7280&, 7281& and 7282L, respectively).

Bleach/amylase/protease combinations (EP 755,999 A; EP 756,001 A; EP 756,000 A) are also useful.

Also in relation to enzymes herein, enzymes and their directly linked inhibitors. e.g., protease and its inhibitor linked by a peptide chain as described in WO 98/13483 A, are useful in conjunction with the present hybrid builders. Enzymes and their non-linked inhibitors used in selected combinations herein include protease with protease inhibitors selected from proteins, peptides and peptide derivatives as described in WO 98/13461 A, WO 98/13460 A, WO 98/13458 A, WO 98/13387 A.

Amylases can be used with amylase antibodies as taught in WO 98/07818 A and WO 98/07822 A, lipases can be used in conjunction with lipase antibodies as taught in WO 98/07817 A and WO 98/06810 A, proteases can be used in conjunction with protease antibodies as taught in WO 98/07819 A and WO 98/06811 A, Cellulase can be combined with cellulase antibodies as taught in WO 98/07823 A and WO 98/07821 A. More generally, enzymes can be combined with similar or dissimilar enzyme directed antibodies, for example as taught in WO 98/07820 A or WO 98/06812 A.

The preferred enzymes herein can be of any suitable origin, such as vegetable, animal, bacterial, fungal and yeast origin.

Preferred selections are influenced by factors such as pH-activity and/or stability optimal thermostability, and stability to active detergents, builders and the like. In this respect bacterial or fungal enzymes are preferred, such as bacterial amylases and proteases, and fungal cellulases.

Pro-perfume and/or Enduring Perfume

The present detergent compositions include those wherein a hybrid builder is combined with a pro-perfume, pro-accord and/or a particular, enduring perfume system. Such selected ingredients are disclosed more fully in EP 864,642 A1; EP 864,642 A1; WO98/07809 A or WO98/07814 A or WO98/07812 A or WO98/07683 A or WO98/07407 A or WO98/27192 A or WO98/07811 A (beta keto-esters); WO97/34986 A or WO97/34989 A or WO97/34578 A1 or WO98/27190 A or WO98/06803 A (pro-fragrant acetals and/or ketals); WO9731094 A1 or U.S. Pat. No. 5,500,138 (enduring perfume system) WO96/29281 A (schiff bases and/or esters); U.S. Pat. No. 5,668,102 (esters of non-allylic perfume alcohols); and ZA9610649 A (sulfonates of perfume alcohols)

End-capped Soil Release Agents

End-capped polymeric soil release agents (see, for example, U.S. Pat. No. 5,415,807, WO96/18715 A2, WO97/23542 A1 and many other patents to Gosselink et al) are especially useful in conjunction with the present hybrid builder materials. Suitable SRA's can have an oligomeric ester backbone of terephthaloyl and oxyalkyleneoxy repeat units and allyl-derived sulfonated terminal moieties covalently attached to the backbone as described in U.S. Pat. No. 4,968,451; nonionic end-capped 1,2-propylene/polyoxyethylene terephthalate polyesters as in U.S. Pat. No. 4,711,730; partly- and fully- anionic-end-capped oligomenrc esters of U.S. Pat. No. 4,721,580; the nonionic-capped block polyester oligomeric compounds of U.S. Pat. No. 4,702,857; and the anionic, especially sulfoaroyl, end-capped terephthalate esters of U.S. Pat. No. 4,877,896, the latter being typical of SRA's useful in both laundry and fabric conditioning products, an example being an ester composition made from m-sulfobenzoic acid monosodium salt, PG and DMT optionally but preferably further comprising added PEG, e.g. PEG 3400.

Another preferred SRA is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as taught in U.S. Pat. No. 5,415,807.

Yet another group of preferred SRA's are oligomeric esters of empirical formula: {(CAP)x(EG/PG)y'(DEG)y"(PEG)y'"(T)z(SIP)z'(SEG)q(B)m} Preferred SEG and CAP monomers for these esters include Na-2-(2-,3-dihydroxypropoxy)ethanesul fonate ("SEG"), Na-2-{2-(2-hydroxyethoxy) ethoxy} ethanesulfonate ("SE3") and its homologs and mixtures thereof and the products of ethoxylating and sulfonating allyl alcohol. Preferred SRAE esters in this class include the product of transesterifying and oligomerizing sodium 2-{2-(2-hydroxyethoxy) ethoxy}ethanesulfonate and/or sodium 2-[2-{2-(2-hydroxyethoxy)-ethoxy}ethoxy]ethanesulfonate. DMT, sodium 2-(2,3-dihydroxypropoxy) ethane sulfonate. EG, and PG using an appropriate Ti(IV) catalyst and can be designated as (CAP)2(T)5(EG/PG)1.4(SEG)2.5(B)0.13 wherein CAP is (Na+ —$O_3S[CH_2CH_2O]$3.5)— and B is a unit from glycerin and the mole ratio EGIPG is about 1.7:1 as measured by conventional gas chromatography after complete hydrolysis.

Processing of Hybrid Builder With Film-forming Polymers

Certain embodiments of builder systems and detergent compositions of the present invention, especially those in granular or powder form, can also contain from about 0.1% to about 10%, typically from about 0.3% to about 7%, preferably from about 0.3% to about 4%, more preferably 0.5% to about 2.5% by weight of a film-forming polymer soluble in an aqueous slurry comprising the organic surfactants, aluminosilicate materials, and neutral or alkaline salts herein. The polymer must be at least partially soluble in the slurry for it to dry to a film capable of cementing the granule walls together as the slurry is dried. For optimum granule physical properties, the polymer should be substantially soluble in the slurry, and is preferably completely soluble in the slurry. The slurry will typically comprise a surfactant phase and the insoluble aluminosilicate material suspended in a solution (often saturated) of the neutral or alkaline salt, which preferably comprises sodium sulfate. The slurry will usually be alkaline in nature due to the presence of the aluminosilicate material and either anionic surfactants or alkaline salts. Since the slurry will generally be a strong electrolyte solution, optimum solubility of the polymer is obtained when it is in the form of an at least partially neutralized or substituted alkali metal, ammonium or substituted ammonium (e.g, mono-, di- or triethanol ammonium) salt. The alkali metal, especially sodium, salts are most preferred. While the molecular weight of the polymer can vary over a wide range, it preferably is from about 1000 to about 500,000, more preferably is from about 2000 to about 250,000, and most preferably is from about 3000 to about 100,000. Suitable film-forming polymers herein include homopolymers and copolymers of unsaturated aliphatic mono- or polycarboxylic acids. Preferred carboxylic acids are acrylic acid, hydroxyacrylic acid, methacrylic acid, maleic acid, fumaric acid, itaconic acid, aconitic acid, crotonic acid, and citraconic acid. The polycarboxylic acids (e.g, maleic acid) can be polymerised in the form of their anhydrides and subsequently hydrolyzed. The copolymers can be formed of mixtures of the unsaturated carboxylic acids with or without other copolymerisable monomers, or they can be formed from single unsaturated carboxylic acids with other copolymerisable monomers. In either case, the percentage by weight of the polymer units derived from non-carboxylic acids is preferably less than about 50%. Suitable copolymerisable monomers include, for example, vinyl chloride, vinyl alcohol, furan, acrylonitrile, vinyl acetate, methyl acrylate, methyl methacrylate, styrene, vinyl methyl ether, vinyl ethyl ether, vinyl propyl ether, acrylamide, ethylene, propylene and 3-butenoic acid. Preferred polymers of the above group are the homopolymers and copolymers of acrylic acid, hydroxyacrylic acid, or methacrylic acid, which in the case of the copolymers contain at least about 50%, and preferably at least about 80%, by weight of units derived from the acid. Particularly preferred polymers are sodium polyacrylate and sodium polyhydroxyacrylate. Other specific preferred polymers are the homopolymers and copolymers of maleic anhydride, especially the copolymers with ethylene, styrene and vinyl methyl ether. These polymers are commercially available under the trade names Versicol and Gantrez. The polymerisation of acrylic acid homo- and copolymers can be accomplished using free-radical initiators, such as alkali metal persulphates, acyl and aryl peroxides, acyl and aryl peresters and aliphatic azo compounds. The reaction can be carried out in situ or in aqueous or non-aqueous solutions or suspensions. Chain-terminating agents can be added to control the molecular weight. The copolymers of maleic anhydride can be synthesised using any of the types of free-radical initiators mentioned above in suitable solvents such as benzene or acetone, or in the absence of a solvent, under an inert atmosphere. These polymerisation techniques are well known in the art. It will be appreciated that instead of using a single polymeric aliphatic carboxylic acid, mixtures of two or more polymeric aliphatic carboxylic acids can be used to prepare the above polymers. Other film-forming polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group. Other suitable film-forming polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,919,107, Thompson, issued Nov. 11, 1975; the hydroxyalkyl starch ethers, starch esters, oxidized starches, dextrins and starch hydrolysates described in U.S. Pat. No. 3,803,285, Jensen, issued Apr. 9, 1974; and the carboxylated starches described in U.S. Pat. No. 3,629,121, Eldib, issued Dec. 21, 1971; all incorporated herein by reference. Preferred polymers of the above group are the carboxymethyl celluloses. Particularly preferred polymers for use herein are copolymers of acrylamide and acrylate having a molecular weight of from about 3,000 to about 100,000, preferably from about 4,000 to about 20,000, and an acrylamide content of less than about 50%, preferably less than about 20%, of the polymer. Most preferably, the polymer has a molecular weight of from about 4,000 to about 10,000 and an acrylamide content of from about 5% to about 15%. Such a polymer acts to increase the percentage of a crutcher mix that is in the aqueous (lye) phase. This improves the rate at which droplets of the crutcher mix will dry in a spray tower and can desirably increase the density of the resulting detergent granules when, for example, large amounts of sodium sulfate or other high-density inorganic salt is in the lye phase.

U.S. Pat. No. 4,379,080 issued Apr. 5, 1983 provides additional detail; in particular, description of useful spray drying processes which can be used to combine the present hybrid builders with film-forming polymers.

Organic Builders

The present detergent compositions also include those wherein a hybrid builder is combined with organic builders selected from polycarboxylates, more particularly those of JP10147640 A derived from catalytic-oxidation of (a) OH-containing compounds selected from glycerine, glyceric acid (GA), glycerates, tartronic acid (TA) and tartronates in the presence of (b) metal salts selected from Fe salts and Zn salts as catalysts and polymerising (c) kctomalonic acid or its salts;

compositions comprising alkali metal or ammonium borates and compounds having at least two OH groups in vicinal configuration as disclosed in WO96/38523 A;

succinic acid derivatives of mono, di or tri-pentaerythritol as disclosed in WO96/22961 A;

improved types of polyacetal carboxylates as disclosed in EP 803,521 A;

tartronic acid prepared by catalytic oxide, of e.g, glycerine as disclosed in JP08151345 A, JP08092156 A;

di- or oligotartaric acids as disclosed in DE19523116 A1;

sugar acid succinates as disclosed in DE19515899 A1;

dextrin, optionally oxidized as disclosed DE19613880 A1; WO97/20905 A; DE19545727 A1; DE19545723 A1;

oxidized starch and/or polysaccharides and/or maltodextrins as disclosed in WO96/29351 A; WO96/27618 A; DE4426443 A; WO9827118 A; JP09249892 A; WO97/32903 A; JP09188704 A; EP 755,944 A; WO9638484 A;

cysteic monosuccinates as disclosed in WO97/23450 A;

soluble aminoether carboxylic acids as disclosed in JP10204045 A; JP10204044 A; JP10088189 A; and mixtures thereof.

Functional Polymers Other Than Soil Release Agents and/or Film-forming Polymers The present detergent compositions also include those wherein a hybrid builder is combined with a functional polymer other than a soil release agent or film-fonning polymer as defined hereinabove.

Preferred among such polymers are one or more members selected from the group consisting of:

hydrophobically modified polyacrylates (see, for example, EP 812,905 A2, EP 786,516 A2; such materials are available from Rohm & Haas, National Starch and others);

terpolymers comprising acrylate or maleate (see, for example, U.S. Pat. No. 4,647,396, U.S. Pat. No. 4,698,174, EP 608,845; such materials are available from Rohm & Haas and others);

polymeric dye transfer inhibitors (for example PVPNO, see for example EP-704523 A1 or WO96/20996 A1 or polymers of DE19621509 A1 or WO96/37598 A1 available from BASF;

polyamines (see, for example WO97/00936 A1, WO97/23546 A1, WO97/28207 A1, WO97/42285 A1 and WO 97/35950 A1);

polyimine derivatives such as ethoxylated/propoxylated polyalkyleneamine polymers (see for example U.S. Pat. No. 5,565,145) or functionalized backbone polyamines (see WO97/42286 A1);

polymeric rheology modifiers (see, for example modified polysaccharides, known "deflocculating polymers"—see for example U.S. Pat. No. 5,147,576, and mixtures thereof); and mixtures of any of the foregoing polymers.

Softeners

The present hybrid builders can be used with certain specific softeners with excellent results. For example, softening-through-the wash detergents or additives can be prepared by combining the hybrid builders with cationic biodegradable softeners as disclosed in EP 831,144 A, ZA9702461 A, WO97/34976 A, WO 97/36976 A; biodegradable di ester quatemary ammonium compounds as disclosed in WO 98/03619 A; softeners having hydrolyzable moieties as disclosed in WO97/34975 A; quats with mono-long chain softeners as disclosed in WO97/34972 A; unsaturated softeners as disclosed in WO98/17757 A; chelant/unsaturated softener combinations as disclosed in WO97/13828 A; esterquats and unsaturated fatty acids as disclosed in WO 97/11142 A; low-odor softeners as disclosed in WO 98/47991 A; dryer-activated softeners as disclosed in U.S. Pat. No. 5,830,835; clear softeners as disclosed in WO98/17756 A, WO 97/03160 A; EP-839899 A1, carboxylic quaternar, ammonium fabric softener plus cationic nitrogen containing charge booster(s) combinations as disclosed in WO 98/12292 A; U.S. Pat. No. 5,733,855 A; WO 98/12293

A; WO 98/08924 A; or dispersible polyolefins as disclosed in WO97/46654 A.

Fillers and Bars, Especially Syndet Bars

The present hybrid builder materials are usefully incorporated into laundry bars or syndet bars, which can be made by any known technique. In such combinations, some preferred combinations with the hybrid builder are with fillers such as magnesium or calcium sulfates, kaolin, clays, hydroxysodalite, or the like; divalent metal sulfates as disclosed in WO98/20103 A; soap/syndet/starch combinations as disclosed in WO98/18896 A; in bars of enhanced firmness as disclosed in AU 9656053 A; with enzymes as disclosed in WO98/18897 A; with dihydric alcohols as disclosed in WO98/16611 A; pour-molded with soap-based network structures as disclosed in WO98/11864 A; with anionic detergents, soaps, polyphosphates and specified poly hydroxy fatty acid amides as disclosed in WO98/05752 A; with absorbent gellino materials as disclosed in U.S. Pat. No. 5,703,026; as pour-molded bars made by alcohol-free processes as disclosed in U.S. Pat. No. 5,703,025 or with paraffin wax, WO 97/22684 A; in bars with anionic synthetic detergent surfactant, bleaching agent and non liquid thixotropic binding agents as disclosed in WO97/44434 A; in bars with soil-releasing agents as disclosed in WO97/42283 A, BR 9502489 A; in bars with cellulase as disclosed in WO 97/36985 A; in bars with chelant as disclosed in CN 1107884 A; or in bars with bleach and enzyme as disclosed in WO 97/08283 A.

Detergent Adjuncts Other Than Class I Adjuncts

Detergent Surfactants

The detergent compositions of the invention can contain one or more conventional detergent surfactants chosen from soap and non-soap anionic, cationic, nonionic, amphoteric and zwitterionic detergent-active compounds, and mixtures thereof. Many suitable surfactants are available and are described in the literature, for example, in "Surface-Active Agents and Detergents", Volumes I and II, by Schwartz, Perry and Berch, in the well-known Mc Cutcheon's, and in the "Surfactant Science Series" of texts published by Marcel Dekker, New York. Preferred surfactants include synthetic non-soap anionic and nonionic types, though soaps, including those derived from vegetable sources, can also be used, especially in bars.

Anionic surfactants are well-known and include alkylbenzene sulphonates, e.g., "linear" types having an alkyl chain length of C8–C15 or non-biodegradable "hard-branched" types though these latter types are relatively undesirable, especially where not permitted by legislation or where environmental considerations are paramount. Primary and secondary alkyl sulphates, particularly C12–C15 primary alkyl sulphates; alkyl ether sulphates; olefin sulphonates; alkyl xylene sulphonates; dialkyl sulphosuccinates; and fatty acid ester sulphonates, such as methyl ester sulfonates, can be used. Sodium salts are typically preferred.

Nonionic surfactants that may be used include pnmary and secondary alcohol ethoxylates, especially C8–C20 primary and secondary aliphatic alcohols ethoxylated with from 1 to 20 moles of ethylene oxide per mole of alcohol, and more especially C9–C15 primary aliphatic alcohols ethoxylated with an average of from 1 to 10 moles of ethylene oxide per mole of alcohol. The corresponding derivatives of Guerbet, Exxal®, Isofol® or Lial® alcohols can also be useful.

Also of interest are non-ethoxylated nonionic surfactants, for example polyhydroxyamides. The choice of detergent-active compound (surfactant), and the amount, will depend on the intended use of the composition: different surfactant systems may be chosen for handwashing products and for products intended for use in different types of washing machine.

The surfactant system can optionally be complemented by one or more cationic surfactants, such as fatty alkyl trimethylammonium salts or variants thereof.

Examples of other suitable cationic surfactants are described in following documents, all of which are incorporated by reference herein in their entirety: M.C. Publishing Co., McCutcheon's, Detergents & Emulsifiers, (North American edition 1997); Schwartz, et al. Surface Active Agents. Their Chemistry and Technology. New York: Interscience Publishers, 1949; U.S. Pat. No. 3,155,591; U.S. Pat. No. 3,929,678; U.S. Pat. No. 3,959,461 U.S. Pat. No. 4,387,090 and U.S. Pat. No. 4,228,044.

Additionally, special-purpose surfactants, for example the linear or branched $C_8$–$C_{20}$, fatty alkyldimethylamine-N-oxides may be added for grease cleaning. Cationic or amine oxide surfactants, when present, are typically used at levels below about 5%, more generally at levels in the range from about 0.1% to about 2%.

The total amount of surfactant system present will also depend on the intended end use, but suitably ranges from about 2% to about 60 wt. %, preferably from 5% to 40 wt. %.

Detergent compositions suitable for use in most automatic fabric washing machines generally contain anionic non-soap surfactant, or nonionic surfactant, or combinations of the two in any ratio, optionally together with soap Builders As noted, the detergent compositions of the invention contain a hybrid aluminosilicate as described in detail hereinbefore as a detergency builder. This material may be complemented by one or more of the above-identified Class I adjuncts or any of the following detergency builders. The total amount of detergency builder in the compositions, including the hybrid aluminosilicate and other builders, if present, will suitably range from 10 to 85 wt. %.

A suitable complementary builder is selected from zeolite A, zeolite P, zeolite X, zeolite AX (or any other co-crystallized zeolite having equivalent effect), maximum aluminum zeolite P, and mixtures thereof The amount of zeolite present may suitably range from 5 to 60 wt. %, more preferably from 15 to 40 wt. %, calculated on an anhydrous basis (equivalent to from 6 to 75 wt. %, preferably from 19 to 50 wt. %, calculated on a hydrated basis).

The zeolite may, if desired, be used in conjunction with other inorganic or organic builders. Inorganic builders that may be present include sodium carbonate. Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates. carboxymethyloxysuccinates, carboxymethyloxymalonates, dipicolinates, hydroxyethyliminodiacetates, alkyl- and alkenylmalonates and succinates; and sulphonated fatty acid salts though this list is not intended to be exhaustive.

Other organic builders useful herein include polyacetal carboxylates, for example polymers and copolymers having polyglyoxylate structural units; see, for example, U.S. Pat. No. 4,146,495; U.S. Pat. No. 4,140,676; EP 803,521 A; such materials are available from Monsanto, Nippon Shokubai. BASF and others.

Preferred supplementary builders for use in conjunction with the hybrid aluminosilicate include citric acid salts, more especially sodium citrate, suitably used in amounts of from 3 to 20 wt. %, more preferably from 5 to 15 wt. %. Other supplementary builders are the water-soluble or partly water-soluble silicates, whether crystalline or amorphous. These include the so-called layer silicates such as SKS-6 from Hoechst/Clariant and/or common 2-ratio or 3-ratio soluble silicates. Such materials, when present, are typically used at levels in the range from about 0.1% to about 20% of the composition; more commonly, the level is below about 10%.

In more detail, suitable silicate builders include water-soluble and hydrous solid types and including those having chain-, layer-, or three-dimensional-structure as well as amorphous-solid silicates or other types. Preferred are alkali metal silicates, particularly those liquids and solids having a $SiO_2$:$Na_2O$ ratio in the range 1.6:1 to 3.2:1, including solid hydrous 2-ratio silicates marketed by PQ Corp, under the tradename BRITESIL®, e.g., BRITESIL H2O; and layered silicates, e.g., those described in U.S. Pat. No. 4,664,839, May 12, 1987, H. P. Rieck. NaSKS-6 or "SKS-6", is a crystalline layered aluminum-free $\delta$-$Na_2SiO_5$ silicate marketed by Hoechst and is preferred especially in granular laundry compositions. See DE-A-3,417,649, DE-A-3,742,043 and technical publications of Hoechst/Clariant, for example Surfactant Science Series, Marcel Dekker, New York, see Vol. 71, Ed. M. S. Showell, published 1998. See more particularly Chapter 3, "Builders: The Backbone of Powdered Detergents" by Hans-Peter Rieck of Hoechst/Clariant.

Other layered silicates, such as those having the general formula $NaMSi_yO_{2x-1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the $\alpha$, $\beta$ and $\gamma$ layer-silicate forms. Other silicates may also be useful, e.g, magnesium silicate, for example for bleach stabilizing or process aid purposes.

Also suitable herein are crystalline ion exchange materials or hydrates having chain structure and a composition represented by: $xM_2O.ySiO_2.zM'O$ as anhydride wherein M is Na and/or K, M' is Ca and/or Mg; y/x is 0.5 to 2.0 and z/x is 0.005 to 1.0 as taught in U.S. Pat. No. 5,427,711.

Conventional aluminosilicate builders or zeolites can be useful in certain embodiments. These include materials having formula: $[M_z(AlO2)_z(SiO2)_v].xH_2O$ wherein z and v are integers of at least 6, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al. Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(Al_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona. Other useful carbonate builders are those of U.S. Pat. No. 5,658,867 issued Aug. 19, 1997, to Pancheri et al incorporated herein by reference or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds or for use in synthetic detergent bars.

Also preferred to complement the builder in certain embodiments are polycarboxylate polymers, more especially acrylic/maleic copolymers, suitably used in amounts of from 0.5 to 15 wt. %, especially from 1 to 10 wt. %, of the detergent composition. The invention however includes embodiments from which such conventional polycarboxylate polymers are substantially absent. The term "substantially absent" means that no amount is deliberately added though adventitious amounts may be present, for example as a result of presence in a preformulated additive, such as a particulate enzyme additive.

Bleach

Detergent compositions of the invention can also include one or more components of a conventional bleach system. Such a bleach system may generally comprise any source of oxidative or reductive bleach, for example chlorine bleaches such as hyophalite, especially hypochlorite; any hypohalite precursor, such as sodium dichloroisocyanurate; or any reductive bleach, for example sodium hydrosulphite or sodium bisulfite. Preferred bleach systems include those which are oxidative and comprise at least one source of bleaching oxygen. Most generally, for example, when using a transition-metal bleach catalyst, there is no need for any source of bleaching oxygen other than oxygen from the air. Quite typically, however, a source of bleaching oxygen is added into the formulation. Such sources of bleaching oxygen include hydrogen peroxide, sodium perborate monohydrate, sodium perborate tetrahydrate, sodium percarbonate, any other salt or adduct capable of releasing hydrogen peroxide in water, and mixtures thereof.

Conventional bleach systems also often include hydrophilic bleach activators (bleach precursors) or the corresponding peracids, for example TAED (tetraacetylethylenediamine) or peracetic acid. Bleach stabilizers, for example heavy metal sequestrants and/or free radical inhibitors, may also be present. In certain instances, for example, low levels of tin compounds are used to stabilize bleach. In detergent compositions herein, sodium percarbonate or other persalts may be present in an amount of from 5 to 30 wt. %, preferably from 10 to 25 wt. %. Bleach activators are suitably used in amounts of from 1 to 8 wt. %, preferably from 2 to 5 wt. %. Organic or inorganic peroxyacids can also be used. These are normally in an amount within the range of from 2 to 10 wt. %, preferably from 4 to 8 wt. %.

Enzymes

Conventional proteases and/or amylases can be used in the present compositions, for example Savinase®, Termamyl® available from Novo or enzymes as taught in WO 98/42622, Englehard.

Polymeric Soil Release Agent

Polymeric soil release agents, hereinafter "SRA" or "SRP's", can be used herein. Levels include from 0.01% to 10.0%, typically from 0.1% to 5%, preferably from 0.2% to 3.0%. Preferred SRA's can have hydrophilic segments and hydrophobic segments and can include charged, e.g., anionic or even cationic (see U.S. Pat. No. 4,956,447), as well as noncharged monomer units. Structures may be linear, branched or even star-shaped. Preferred SRA's include oligomeric terephthalate esters, e.g., made by transesterification/oligomerization with a suitable catalyst. Such esters may incorporate additional monomers binding through one, two, three, four or more positions, generally without heavy crosslinking.

SRA's also include those with segments of ethylene terephthalate or propylene terephthalate with ethylene oxide or propylene oxide, see U.S. Pat. No. 3,959,230 and U.S. Pat. No. 3,893,929; cellulosic derivatives such as the hydroxyether cellulosic polymers available as METHOCEL from Dow; and the $C_1$–$C_4$ alkylcelluloses and $C_4$ hydroxyalkyl celluloses; see U.S. Pat. No. 4,000,093. Suitable SRA's characterized by poly(vinyl ester) hydrophobe segments include graft copolymers of poly(vinyl ester), e.g. $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available SRA's include SOKALAN SRA's such as SOKALAN HP-22, available from BASF, Germany. Other SRA's are polyesters with repeat units containing 10–15% by weight of ethylene terephthalate together with 90–80% by weight of polyoxyethylene terephthalate, derived from a polyoxyethylene glycol of average molecular weight 300–5,000. Commercial examples include ZELCON 5126 from duPont and MILEASE T from ICI.

Additional classes of SRA's include (I) nonionic terephthalates using diisocyanate coupling, agents to link up polymeric ester structures, see U.S. Pat. No. 4,201,824 and U.S. Pat. No. 4,240,918; (II) SRA's with carboxylate terminal groups made by adding tnrmellitic anhybride to known SRA's to convert terminal hydroxyl groups to trimellitate esters. See also U.S. Pat. No. 4,525,524; (III) anionic terephthalate-based SRA's of the urethane-linked vanety, see U.S. Pat. No. 4,201,824; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681; (V) graft copolymers, in addition to the SOKALAN types from BASF made, by grafting acrylic monomers on to sulfonated polyesters; these SRA's assertedly have soil release and anti-redeposition activity similar to known cellulose ethers: see EP 279,134 A, 1988; (VI) grafts of vinyl monomers such as acrylic acid and vinyl acetate on to proteins such as caseins, see EP 457,205 A. 1991; (VII) polyester-polyamide SRA's prepared by condensing adipic acid, caprolactam, and polyethylene glycol, especially for treating polyamide fabnrcs, see DE 2,335,044 1974. Other useful SRA's are described in U.S. Pat. Nos. 4,240,918, 4,787,989, 4,525,524 and 4,877,896.

Clay Soil Removal/Anti-redenosition Agents

The compositions of the present invention can also optionally contain water-soluble ethoxylated or acylated amines or polyamines having clay soil removal and antiredeposition properties. Granular detergent compositions which contain these compounds typically contain from about 0.01% to about 10.0% by weight of the water-soluble ethoxylated amines; liquid detergent compositions typically contain about 0.01% to about 5%.

A preferred soil release and anti-redeposition agent is ethoxylated tetraethylene pentamine. See U.S. Pat. No. 4,597,898. See also European Patent Application 111,965, published Jun. 27, 1984. Other clay soil removal/antiredeposition agents which can be used include the ethoxylated amine polymers disclosed in European Patent Application 111,984, published Jun. 27, 1984; the zwitterionic polymers disclosed in European Patent Application 112,592, published Jul. 4, 1984; and the amine oxides disclosed in U.S. Pat. No. 4,548,744. Other clay soil removal and/or anti redeposition agents are disclosed in U.S. Pat. No. 4,891,160, and WO 95/32272, published Nov. 30, 1995. Another type of preferred antiredeposition agent includes the known cellulosic materials such as carboxy methyl cellulose (CMC).

Polymeric Dispersing Agents

Polymeric dispersing agents can be used herein at levels from about 0.1% to about 7%, by weight, especially in the presence of hybrid aluminosilicates, zeolite and/or layered silicate builders. Such agents include polymeric polycarboxylates and polyethylene glycols. Polymeric dispersing agents are believed to enhance detergent builder performance, by mechanisms such as crystal growth inhibition, particulate soil release, peptization, or anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhybride), fumaric acid, itaconic acid, aconitic acid, mesaconic acid, citraconic acid and methylenemalonic acid. The presence in the polymeric polycarboxylates herein or monomeric segments, containing no carboxylate radicals such as vinvimethyl ether, styrene, ethylene, etc. is suitable provided that such segments do not constitute more than about 40% by weight.

Particularly suitable polymeric polycarboxylates can be derived from acrylic acid, as in water-soluble salts of polymerized acrylic acid. The average molecular weight of such polymers preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. See U.S. Pat. No. 3,308,067.

Acrylic/maleic-based copolymers may also be used. Such materials include the water-soluble salts of copolymers of acrylic acid and maleic acid. The average molecular weight of such copolymers preferably ranges from about 2,000 to 100,000, more preferably from about 5,000 to 75,000, most preferably from about 7,000 to 65,000. The ratio of acrylate to maleate segments will generally range from about 30:1 to about 1:1, more preferably from about 10:1 to 2:1. Alkali metal, ammonium and substituted ammonium salts of the polymers can be used. See European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used. A preferred average molecular weight is about 10,000.

Other polymer types which may be used include various terpolymers and hydrophobically modified copolymers, including those marketed by Rohm & Haas, BASF Corp., Nippon Shokubai and others for all manner of water-treatment, textile treatment, or detergent applications.

Brightener

Any optical brighteners or other brightening or whitening agents known in the art can be incorporated at levels typically from about 0.01% to about 1.2%, by weight, into the detergent compositions herein. Suitable brighteners include those identified in U.S. Pat. No. 4,790,856. These include PHORWHITE brighteners from Verona. Other brighteners disclosed in '856 include: Tinopal UNPA, Tinopal CBS and Tinopal 5BM: available from Ciba-Geigy: Arctic White CC and Arctic White CWD, the 2-(4-styryl-phenyl)-2H-naptho[1,2-d]triazoles; 4,4'-bis-(1,2,3-triazol-2-yl)-stilbenes. 4,4'-bis(styryl)bisphenyls; and the aminocoumarins. Specific examples of these brighteners include 4-methyl-7-diethyl-amino coumarin; 1,2-bis(benzimidazol-2-yl)ethylene; 1,3-diphenyl-pyrazolines; 2,5-bis (benzoxazol-2-yl)thiophene: 2-styryl-naptho[1,2-d]oxazole; and 2-(stilben-4-yl)-2H-naphtho[1,2-d]triazole. See also U.S. Pat. No. 3,646,015.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, and certain materials accounted for in the bleach system such as zinc, manganese, aluminum and silicon phthalocyanines, peroxidases, and mixtures thereof If used, these agents typically comprise from about 0.01% to about 10% by weight of the composition, preferably from about 0.01% to about 5%, and more preferably from about 0.05% to about 2%.

Chelating Agents

Detergent compositions herein may also optionally contain one or more chelating agents for metals such as iron and/or manganese in water-soluble, colloidal or particulate form or associated as oxides or hydroxides, or found in association with soils such as humic substances. Preferred chelants effectively control such transition metals, especially limiting deposition of such transition-metals or their compounds on fabrics and/or controlling undesired redox reactions in the wash medium and/or at fabric or hard surface interfaces. Such chelating agents include those having low molecular weights as well as polymeric types, typically having at least one, preferably two or more donor heteroatoms such as O or N, capable of co-ordination to a transition-metal, Common chelating agents can be selected from the group consisting of aminocarboxylates, aminophosphonates, polyfunctionally-substituted aromatic chelating agents and mixtures thereof. Preferred chelating agents (chelants) include EDTA, S,S'-EDDS, DTPA, phosphonate types such as HEDP and mixtures thereof.

If utilized, chelating agents will generally comprise from about 0.001% to about 15% by weight of detergent composition. More preferably, chelating agents will comprise from about 0.01% to about 3.0% by weight of the composition. Suds Suppressors—Suds suppressors useful herein may be single materials or may be mixed or compounded in known ways. See, for example, Kirk Othmer Encyclopedia of Chemical Technology, 3rd. Ed., Vol. 7, ppg 430–447 (John Wiley & Sons. Inc. 1979). Common suds suppressors include C10–C24, preferably C16–C18 monocarboxyilc fatty acids and salts thereof. See U.S. Pat. No. 2,954,347. Suitable salts include Na, K, Li, Ca, Mg, Al, Zn, ammonium and alkanolammonium salts. Stearic acid and aluminium tristearate are common examples. Alternate suds suppressors include high molecular weight liquid or waxy linear, cyclic or mixed C12–C70 hydrocarbons (see U.S. Pat. No. 4,265,779) such as paraffins or haloparaffins; fatty acid esters such as fatty acid triglycerides; fatty acid esters of monovalent alcohols; aliphatic $C_{18}$–$C_{40}$ ketones such as stearone; N-alkylated aminotriazines such as tri- to hexa-alkylmelamines or di- to tetra-alkyldiamine chlortriazines; and hydrocarbyl, especially stearyl, preferably monostearyl, phosphate esters such as monostearyl acid phosphate. Another preferred category of suds suppressors comprises silicone suds suppressors including polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. See U.S. Pat. No. 4,265,779, EP 89307851.9, U.S. Pat. No. 3,455,839, and German Patent Application DOS 2,124,526. Silicone defoamers and suds controlling agents in granular detergent compositions are further disclosed in U.S. Pat. No. 3,933,672 and U.S. Pat. No. 4,652,392. In certain preferred silicone suds suppressors useful herein, a solvent for a continuous phase is made up of certain polyethylene glycols or polyethylene-polypropylene glycol copolymers or mixtures thereof (preferred), or polypropylene glycol. The primary silicone suds suppressor is branched/crosslinked. Certain liquid laundry detergent compositions with controlled suds will comprise from about 0.001 to about 1, most preferably from about 0.05 to about 0.5, weight % of silicone suds suppressor comprising (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. No. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol. which is available from Condea under the trademark ISOFOL 12. Mixtures of secondar alcohols are available under the trademark ISALCHEM 123 from Enichem. Mixed suds suppressors typically comprise mixtures of alcohol×silicone at a weight ratio of 1:5 to 5:1.

Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

Other Ingredients

A wide variety of other ingredients useful in detergent compositions can be included in the compositions herein, including perfumes, enzyme stabilizers, softening clays such as bentonites, montmorillonites, hectorites, other clays such as laponite or kaolin, chlorine scavengers, such as ammonium sulfate; other active ingredients, carriers, hydrotropes, processing aids, dyes or pigments, fillers, especially for bar compositions. etc. If desired, magnesium and/or calcium salts such as $MgCl_2$, $MgSO_4$, $CaCl_2$, $CaSO_4$, magnesium silicates and the like, can be added, for example as fillers for bar forms of the compositions.

Various detersive ingredients employed in the present compositions optionally can be further stabilized by absorbing said ingredients onto a porous hydrophobic substrate, then coating, said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

The detergent compositions herein will preferably be formulated such that, during use in aqueous cleaning operations, the wash water will have a pH of between about 6.5 and about 11, preferably between about 7.0 and 10.5, more preferably between about 7.0 to about 9.5. Techniques for controlling pH at recommended usage levels include the use of buffers, alkalis, acids, etc., and are well known to those skilled in the art.

Form of the Compositions

Compositions herein can vary in physical form, as nonlimitingly illustrated by granular, tablet, bar, and pouch forms. The compositions include the so-called concentrated granular detergent compositions adapted to be added to a washing machine by means of a dispensing device placed in the machine drum with the soiled fabric load.

The mean particle size of the components of granular detergent compositions herein is preferably be such that no more that 5% of particles are greater than 1.7 mm in diameter and not more than 5% of particles are less than 0.15 mm in diameter.

"Mean particle size" herein can be determined by sieving a sample of material to be sized into a number of fractions (typically 5) on a series of Tyler sieves. Weights of fractions are plotted against the aperture size of the sieves. The mean particle size is the aperture size through which 50% by weight of the sample would pass.

Certain preferred granular detergent compositions in accordance herein are high-density types, now common in the marketplace; typically these have a bulk density of at least 600 g/liter, more preferably from 650 g/liter to 1200 g/liter.

Laundry Washing Method

Machine laundry methods herein typically comprise treating soiled laundry with an aqueous wash solution in a washing machine having dissolved or dispensed therein an effective amount of a detergent composition of the invention. By an "effective amount" is here meant from 40 g to 300 g of product dissolved or dispersed in a wash solution of volume from 5 to 65 litres.

In the context of fabric laundering, product "usage levels" can vary widely, depending not only on the type and severity of soils and stains, but also on wash water temperatures and volumes and type of washing machine.

In a preferred use aspect a dispensing device is employed in the washing method. The dispensing device is charged with the detergent product, and is used to introduce the product directly into the drum of the washing machine before the start of the wash cycle. Its capacity should be such as to be able to contain sufficient detergent product as would normally be used in the washing method.

Once the washing machine has been loaded with laundry, the dispensing device containing the detergent product is placed inside the drum. At the commencement of the wash cycle of the washing machine, water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

Alternatively, the dispensing device may be a flexible container, such as a bag or pouch. The bag may be of fibrous construction coated with a water, impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water-frangible closure comprises a water soluble adhesive disposed along and sealing one edge of a pouch formed of a water impermeable polymeric film such as polyethylene or polypropylene.

Abbreviations Used in Examples

| | |
|---|---|
| LAS | Sodium $C_{11-13}$ alkyl benzene sulfonate (linear, branched or mixed) |
| Alkyl Sulfate | CxyAS: Alkyl sulfate, typically sodium salt form, derived from fatty alcohol containing from x to y carbon atoms. Examples include sodium tallow alkyl sulfate (TAS) and primary, guerbet, and mid-chain branched (WO 97/39088) alkyl sulfates containing from 10 to 20 carbon atoms (more typically from 14 to 16 or from 16 to 18) or mixtures thereof. |
| Alkyl Alkoxy Sulfate | Sodium salt of linear or branched (WO 97/39087) fatty alcohol condensed with one or more moles of ethylene oxide, propylene oxide, esp. sodium $C_{1x}$–$C_{1y}$ alkyl sulfate condensed with z moles of ethylene oxide, e.g., C15E1S. |
| Nonionic | linear or branched (WO 97/39091) nonionic surfactant, typically CxyEz, derived from fatty alcohol with chain-length of from x to y condensed with an average of z moles of ethylene oxide Suitable examples include C25E3, C24E5, C45E7. |
| Glucamide | $C_{12}$–$C_{14}$ (coco) alkyl N-methyl glucamide or $C_{16}$–$C_{18}$ alkyl N-methyl glucamide |
| Amine Oxide | linear or branched (WO 97/3909l) C12–C18 Alkyl-dimethylamine N-Oxide |
| QAS | Quaternary ammonium surfactant, e.g., dodecyltrimethyl-ammonium chloride or $R_2.N^+(CH_3)_2(C_2H_4OH)$ $X^-$ with $R_2 = C_{12}$–$C_{14}$ and $X^- = Cl^-$ |
| Fatty Acid | Sodium linear alkyl carboxylate derived from an 80/20 mixture of tallow and coconut fatty acids (longer-chain soaps may be dual-functional and contribute to suds suppression); $C_{12}$–$C_{14}$ topped whole cut fatty acids: mixtures |
| Hybrid builder | Material as disclosed in the Synthesis Examples here-inabove. |
| Zeolite system: one or more of:- | |
| Zeolite A | Hydrated sodium aluminosilicate of formula $Na_{12}(Al0_2SiO_2)_{12}.27H_2O$ having a primary particle size in the range from 0.1 to 10 micrometers (weight expressed on an anhydrous basis) |
| Zeolite P | Zeolite P (may be maximum aluminum type) |
| Zeolite X | Zeolite X |
| Zeolite AX | Zeolites A, X co-crystallized (Condea, EP 816291 A1) |
| Silicate system (hydration of any zeolite may vary) | 2r or 3r sodium silicate; crystalline layered silicate of formula δ-$Na_2Si_2O_5$; (Hoechst/Clariant) Amorphous sodium silicate ($SiO_2$:$Na_2O$ = 2.0:1); mixtures thereof |
| Phosphates: - one or more of | |
| STPP | Anhydrous sodium tripolyphosphate |
| TSPP | Tetrasodium pyrophosphate |
| non-polymer type poly-carboxylate: one or more of:- | |
| Citrate | Anhydrous citric acid; tri-sodium citrate dihydrate of activity 86.4% with a particle size distribution between 425 μm and 850 μm; mixtures thereof |
| TMS/TDS | Tartrate Monosuccinate/Tartrate Disuccinate, Sodium Salts |
| ODS | 2,2'-oxydisuccinate, Sodium Salts |
| CMOS | Carboxymethyloxysuccinate, Sodium Salts |
| NTA | Nitrilotriacetic Acid, Sodium Salts |

-continued

| | |
|---|---|
| Carbonate | Anhydrous sodium or potassium carbonate, e.g., with particle size between 200 μm and 900 μm for admix; or lower, e.g., below 100 μm, if to be further agglomerated. |
| Polymer-type polycarboxy-late | any polycarboxylate of m.w. above about 1,000, especially sodium salt of copolymer of 1:4 maleic/acrylic acid, average molecular weight about 70,000, sodium salt; Sodium polyacrylate of average molecular weight 4,500; mixtures thereof; or mixtures of said polymers with any PEG. A preferred polymer-type poly-carboxylate has polyglyoxylate structural units (see, for example, U.S. Pat. No. 4,146,495; U.S. Pat. No. 4,140,676; EP 803,521 A) |
| Carbohydrate antiredeposi-tion agent | Sodium carboxymethyl cellulose; methyl cellulose ether with a degree of polymerization of 650 available from Shin Etsu Chemicals; starch-derived, sugar-derived, sorbitol-derived or any other carbohydrate-derived antiredeposition agent or ash buildup prevention agent, or mixtures thereof. |
| Enzyme system: one or more of:- | |
| Protease | Proteolytic enzyme of activity 4KNPU/g sold by NOVO Industries A/S under the tradename Savinase |
| Alcalase | Proteolytic enzyme of activity 3AU/g sold by NOVO Industries A/S |
| Cellulase | Cellulolytic enzyme of activity 100 CEVU/g sold by NOVO Industries A/S under the tradename Carezyme |
| Amylase | Amylolytic enzyme of activity 120KNU/g sold by NOVO Industries A/S under the tradename Termamyl 120T |
| Lipase | Lipolytic enzyme of activity 100KLU/g sold by NOVO Industries A/S under the tradename Lipolase |
| Endolase | Endoglucanase enzyme of activity 3000 CEVU/g sold by NOVO Industries A/S |
| Primary Oxygen Bleach | Sodium perborate tetrahydrate of nominal formula $NaBO_2.3H_2O.H_2O_2$ (abbrev. PB4); anhydrous sodium perborate bleach of nominal formula $NaBO_2.H_2O_2$ (abbrev. PB1); sodium percarbonate of nominal formula $2Na_2CO_3.3H_2O_2$ (abbrev. PC); any of these in coated or uncoated forms; or mixtures thereof |
| Hydrophobic Bleach Activator | any water-soluble acylated di- or lower poly-amine, esp. tetraacetylethylenediamine |
| Hydrophobic Bleach Activator | NOBS, i.e., nonanoyloxybenzene sulfonate in the form of the sodium salt; NAC-OBS, i.e., (6-nonamidocaproyl) oxybenzene sulfonate; mixtures; or similar |
| Hydrophobic performed peroxyacid | e.g., EP 778342 A1 |
| Organic Bleach Booster | e.g., omega-(3,4-dihydroisoquinolinium alkane sulfonate(s) of U.S. Pat. No. 5,576,282 |
| Transition-metal Bleach Catalyst | e.g., as described in WO 97/00937, WO 96/06155, EP 718,398 A |
| Photobleach | Sulfonated zinc phthlocyanine encapsulated in bleach dextrin soluble polymer; or low-hue photobleach - see, for example, Si phthalocyanine derivatives of WO 97/05202 |
| Chelant System: one or more of: | |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| HEDP | 1,1-hydroxyethane diphosphonic acid |
| Brightener | Disodium 4,4'-bis(2-sulphostyryl)biphenyl; Disodium 4,4'-bis(4-anilino-6-morpholino-1,3,5-triazin-2-yl)amino) stilbene-2:2'-disulfonate; mixtures |

-continued

| Soil Release Agent: one or more of: | |
|---|---|
| SRP 1 | Sulfobenzoyl and capped esters with oxyethylene oxy and terephthaloyl backbone or SRP of U.S. Pat. No. 5,415,807 |
| SRP 2 | Diethoxylated poly(1,2 propylene terephthalate) short block polymer |
| Cotton Soil Release Agent | e.g., as described in WO 97/42285 |
| TEPAE | Tetraethylenepentaamine ethoxylate |
| PVP | Polyvinylpyrrolidine polymer, with an average molecular weight of 60,000 |
| PVNO | Polyvinylpyridone N-oxide polymer, with an average molecular weight of 50,000 |
| PVPVI | Copolymer of polyvinylpyrolidone and vinylimidazole, with an average molecular weight of 20,000 |
| Antifoam System: | e.g., polydimethylsiloxane foam controller with siloxane-oxyalkylene copolymer as dispersing agent with a ratio of said foam controller to said dispersing agent of 10:1 to 100:1, may be complemented by fatty acid(s). |

-continued

| Other materials | |
|---|---|
| Bicarbonate | Anhydrous sodium bicarbonate with a particle size distribution between 400 $\mu$m and 1200 $\mu$m |
| Sulfate | Anhydrous sodium sulfate |
| Stabilizers, process aids, other minors e.g., one or more of: | |
| Borate | Sodium borate |
| Wax | Paraffin wax |
| PEGx | Polyethylene glycol, with a molecular weight of x |
| PEO | Polyethylene oxide, with an average molecular weight of 50,000 |
| Perfume | Any perfume or pro-perfume, see, for example, "blooming perfume" in WO 97/34987 |

In the following examples all levels are quoted as % by weight of the composition:

EXAMPLE 1

Granular laundry detergents for use in domestic appliances or handwashing of laundry at from 100 to 10,000 ppm, depending on appliance and/or water and/or conditions, are prepared in accordance with the invention:

| Ingredient (Range, % unless noted) | A | B | C | D | E | F |
|---|---|---|---|---|---|---|
| LAS (0–35) | 4 | — | 10 | 20 | 30 | 35 |
| Alkyl Sulfate (0–20) | 10 | 3 | 1 | — | — | — |
| Alkyl Alkoxy Sulfate (0–5) | — | — | 0.5 | — | 5 | — |
| Nonionic (0–15) | 5 | 10 | 2 | 0.5 | 1 | — |
| Glucamide (0–5) | 3 | 1 | — | — | — | — |
| Amine Oxide (0–2) | 0.5 | — | — | 2 | — | — |
| QAS (0–2) | — | — | — | — | 1.8 | 2 |
| Hybrid aluminosilicate (0.1–40) | 1 | 5 | 25 | 10 | 30 | 5 |
| Zeolite system (0–30) | — | 20 | — | — | — | — |
| Carbonate (0–30) | 10 | 10 | 5 | 15 | — | 20 |
| Phosphates (0–30) | — | — | — | — | — | 20 |
| Silicate system (0–20) | 5 | 1 | 3 | — | 2 | 10 |
| Non-polymer type polycarboxylate (0–20) | — | — | 5 | — | 5 | — |
| Polymer-type polycarboxylate (0–20) | 1 | 5 | — | 10 | 4 | — |
| Carbohydrate antiredeposition agent (0–10) | 0.1 | 0.2 | 5 | 0.3 | 0.2 | — |
| Primary Oxygen Bleach (0–20) | 20 | 15 | 10 | 5 | 3 | — |
| Hydrophilic Bleach Activator (0–10) | — | 2 | — | — | 4 | 2 |
| Hydrophilic Bleach Activator (0–10) | — | 2 | 1 | — | 5 | — |
| Organic Bleach Booster (0–5) | — | — | — | 2 | — | — |
| Transition-metal bleach catalyst (0–10,000 ppm) | 10 | 100 | 1000 | — | 50 | 10000 |
| Photobleach (0–1000 ppm) | — | — | 10 | — | 5 | — |
| Chelant System (0–3) | 2 | 1 | 0.5 | 3 | 1 | 0 |
| Enzyme System (0–8) | 8 | — | 3 | 4 | 6 | 1 |
| Brightener (0–2) | 0.1 | 0.1 | 0.1 | 0.2 | 0.3 | 1 |
| Soil Release Agent (0–5) | — | 0.1 | 1 | 2 | — | 0.3 |
| Additional low-level benefit agent (0–5) | — | — | 1 | — | 1 | — |
| Perfume (0–5) | 0.01 | 0.1 | — | 3 | 2 | 1 |
| Antifoam system (0–5) | 0.05 | 0.1 | 0.2 | 0.5 | 0.7 | — |
| Sulfate, stabilizers, process aids, minors to | 100% | 100% | 100% | 100% | 100% | 100% |
| Density in g/litre (range) | 200–900 | 200–900 | 200–900 | 200–900 | 200–900 | 200–900 |

EXAMPLE 2

Granular laundry detergents for use in domestic appliances or handwashing of laundry at from 100 to 10,000 ppm, depending on appliance and/or water and/or conditions, are prepared in accordance with the invention:

| Ingredient (Range, % unless noted) | A | B | C | D | E | F |
|---|---|---|---|---|---|---|
| LAS (0.5–25) | 15 | 15 | 20 | 25 | 5 | 10 |
| Alkyl Sulfate (0.5–15) | — | 15 | 2 | — | 10 | 5 |
| Alkyl Alkoxy Sulfate (0–5) | — | — | 3 | 5 | 5 | 2 |
| Nonionic (0.5–10) | 5 | 1 | 2 | 0.5 | 1 | 0.5 |
| Glucamide (0–5) | — | — | — | — | 2 | 1 |
| QAS (0–2) | 1 | 1 | — | 1.8 | — | 0.5 |
| Hybrid aluminosilicate (1–40) | 1 | 5 | 25 | 10 | 30 | 5 |
| Zeolite system (0–20) | — | 20 | — | — | — | — |
| Carbonate (0–30) | 10 | 10 | 5 | 15 | — | 20 |
| Silicate system (0–15) | 5 | 1 | 3 | — | 2 | 10 |
| Non-polymer type polycarboxylate (0–5) | — | — | 3 | — | 2 | — |
| Polymer-type polycarboxylate (0–9) | 1 | 5 | — | 9 | 4 | — |
| Carbohydrate antiredeposition agent (0–2) | 0.1 | 0.2 | 1 | 0.3 | 0.2 | — |
| Primary Oxygen Bleach (0–20) | 20 | 15 | 10 | 5 | 3 | — |
| Hydrophilic Bleach Activator (0–5) | — | 2 | — | — | 4 | 2 |
| Hydrophobic Bleach Activator (0–8) | — | 2 | 1 | — | 5 | — |
| Photobleach (0–1000 ppm) | — | — | 10 | — | 5 | — |
| Chelant System (0–2) | 2 | 1 | 0.5 | 2 | 1 | 0 |
| Enzyme System (0–3) | 3 | — | 3 | 3 | 3 | 1 |
| Brightener (0–2) | 0.1 | 0.1 | 0.1 | 0.2 | 0.3 | 1 |
| Soil Release Agent (0–3) | — | 0.1 | 1 | 2 | — | 0.3 |
| Additional low-level benefit agent (0–2) | — | — | 1 | — | 1 | — |
| Perfume (0–3) | 0.01 | 0.1 | — | 3 | 2 | 1 |
| Antifoam system (0–3) | 0.05 | 0.1 | 0.2 | 0.5 | 0.7 | — |
| Sulfate, stabilizers, process aids, minors to | 100% | 100% | 100% | 100% | 100% | 100% |
| Density in g/litre (range) | 200–900 | 200–900 | 200–900 | 200–900 | 200–900 | 200–900 |

EXAMPLE 3

Laundry Bar compositions are prepared according to the present invention.

| | I | II | III | IV | V | VI |
|---|---|---|---|---|---|---|
| Tallow Soap | 38.00 | 28.80 | 0.00 | 0.00 | 0.00 | 0.00 |
| Coconut Soap | 9.50 | 7.20 | 0.00 | 0.00 | 0.00 | 0.00 |
| Alkyl Glycerate Ether Sulphonate | 0.00 | 4.00 | 0.00 | 0.00 | 0.00 | 0.00 |
| Coco (C12–C14) Alkyl Sulfate | 0.00 | 0.00 | 15.05 | 15.05 | 0.00 | 0.00 |
| C12–C14 Amine Oxide | 0.00 | 0.00 | 0.00 | 2.50–4.00 | 0.00 | 2.50–4.50 |
| LAS | 2.50 | 2.50 | 6.45 | 15.00–16.50 | 22.00 | 19.0%–22% |
| Coco Fatty Alcohol | 0.00 | 0.00 | 1.5 | 0.00 | 0.00 | 0.00 |
| Coconut Monethanolamide | 0.00 | 0.00 | 1.00 | 0.00 | 0.00 | 0.00–0.00 |
| Sodium Carbonate | 0.00–6.00 | 0.00–6.00 | 0.00–15.00 | 0.00–12.00 | 0.00–12.00 | 0.00–15.00 |
| STPP | 5.00 | 5.00 | 0.00 | 0.00 | 0.00 | 0.00 |
| Zeolite A | 0.00 | 0.00 | 1.00 | 1.00 | 1.00 | 1.00 |
| Carboxymethyl Cellulose | 0.5–1.5 | 0.5–1.5 | 0.40 | 0.50 | 0.00 | 0.50 |
| Polymers | 0.00 | 0.00 | 0.64 | 0.40 | 1.20 | 1.20 |
| DTPA | 0.60 | 0.60 | 0.90 | 0.00 | 0.80 | 0.80 |
| Hybrid Aluminosilicate | 1.00 | 5.00 | 18.00 | 18.00 | 20.00 | 20.00 |
| Calcium Carbonate | 0.00 | 0.00 | 0.00–21.5 | 0.00–25.00 | 0.00 | 0.00 |
| Talc | 0.00–25.00 | 25.00 | 0.00 | 0.00 | 0.00–10.00 | 0.00–10.00 |
| Sodium Perborate | 0.0–4.5 | 0.0 | 4.50 | 0.00–4.50 | 4.50 | 4.50 |
| Amylase | 0.00 | 0.00 | 0.05 | 0.00 | 0.00 | 0.00 |
| Cellulase | 0.00 | 0.00 | 0.00 | 0.08 | 0.00 | 0.02 |
| Protease | 0.00–0.12 | 0.00 | 0.10 | 0.00–0.12 | 0.12 | 0.10 |
| Brightener | 0.20 | 0.20 | 0.20 | 0.20 | 0.22 | 0.32 |
| Photobleach | 0.005 | 0.005 | 0.005 | 0.005 | 0.005 | 0.005 |
| PEG | 0.00 | 0.00 | 0.00 | 0.00 | 1.00 | 1.00 |
| Sodium Borate | 0.00 | 0.00 | 0.00 | 0.00 | 1.50 | 1.00 |
| CaO | 0.00 | 0.00 | 0.00 | 1.80 | 1.80 | 1.80 |
| Sodium Silicate | 0.00 | 0.00 | 0.00 | 3.3 | 2.70 | 2.70 |
| Sodium Sulfate | 0.0 | 0.00 | 9.00 | 0.00 | 0.00 | 0.00 |
| MgSO4 | 2.00 | 1.85 | 0.00 | 0.00 | 3.00 | 0.00 |

-continued

| | I | II | III | IV | V | VI |
|---|---|---|---|---|---|---|
| Water | 17.00 | 17.00 | 3.00 | 2.00–3.00 | 4.70 | 5.0 |
| Balance to 100.00% | balance | balance | balance | balance | balance | balance |

High Density Detergent Composition Processes

Spray-drying towers can be used to make granular laundry detergents or base powders. These often have a density less than about 500 g/l. Typically, an aqueous slurry of ingredients is passed through a spray-drying tower at temperatures of about 175° C. to about 225° C.

Additional process steps must be used to obtain high density, low dosage detergents. "High density" means greater than about 550, typically greater than about 650. grams/liter or "g/l"). Thus spray-dried granules can be densified by loading a liquid, often a nonionic surfactant, into the pores of the granules and/or passing them through one or more high speed mixer/densifiers such as a device sold as a "Lödige CB 30" or "Lödige CB 30 Recycler". This comprises a static cylindrical mixing drum having a central rotating shaft on which are mounted mixing/cutting blades. Ingredients for the detergent composition are introduced into the drum and the shaft/blade assembly is rotated at speeds in the range of 100–2500 rpm to provide thorough mixing/densification. See U.S. Pat. Nos. 5,149,455 and 5,565,422. Other suitable commercial apparatus includes the "Shugi Granulator" and the "Drais K-TTP 80.

Spray-dried granules can also be densified by treating them in a moderate speed mixer/densifier so as to obtain particles, for which the "Lödige KM" (Series 300 or 600) or "Lödige Ploughshare" mixer/densifiers are suitable and are typically operated at 40–160 rpm. Other useful equipment includes the "Drais K-T 160". This process step using a moderate speed mixer/densifier (e.g. Lödige KM) can be used alone or sequentially with the aforementioned high speed mixer/densifier (e.g. Lödige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high speed mixer/densifier followed by the low speed mixer/densifier, the reverse sequential mixer/densifier configuration can also be used. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules. By way of example, see the processes in U.S. Pat. No. 5,133,924; U.S. Pat. No. 4,637,891, (granulating spray-dried granules with a liquid binder and aluminosilicate); U.S. Pat. No. 4,726,908, (granulating spray-dried granules with a liquid binder and aluminosilicate); and U.S. Pat. No. 5,160,657, (coating densified granules with aluminosilicate).

Heat sensitive or highly volatile detergent ingredients are preferably incorporated into the detergent composition without resorting to spray drying, for example, by feeding, thermally sensitive or volatile ingredients continuously or batchwise into mixing/densifying equipment. One preferred embodiment involves charging a surfactant paste and an anhydrous material into a high speed mixer/densifier (e.g. Lödige CB) followed by a moderate speed mixer/densifier (e.g. Lödige KM) to form high density agglomerates. See U.S. Pat. No. 5,366,652 and U.S. Pat. No. 5,486,303. The liquid/solids ratio of ingredients can be selected to obtain high density agglomerates that are more free flowing and crisp. See U.S. Pat. No. 5,565,137.

Optionally, the process may include one or more streams of undersized particles. These can be recycled to the mixer/densifiers for further agglomeration or build-up. Oversized particles can be sent to grinding apparatus, the product of which is fed back to the mixing/densifying equipment. Such recycles facilitate overall particle size control giving in finished compositions which having a relatively uniform distribution of particle size (400–700 microns) and density (>550 g/l). See U.S. Pat. No. 5,516,448 and U.S. Pat. No. 5,489,392. Other suitable processes which do not call for spray-drying are described in U.S. Pat. No. 4,828,721, U.S. Pat. No. 5,108,646 and U.S. Pat. No. 5,178,798.

In yet another embodiment, the high density detergent compositions can be produced using a fluidized bed mixer in which the ingredients are combined as an aqueous slurry (typically 80% solids content) and sprayed into a fluidized bed to provide finished granules. Optionally prior to fluid bed mixing the slurry can be treated using the aforementioned Lödige CB mixer/densifier or a "Flexomix 160" mixer/densifier, available from Shugi. Fluidized bed or moving beds of the type available under the tradename "Escher Wyss" can also be used.

Another alternate process involves feeding a liquid acid precursor of an anionic surfactant, an alkaline inorganic material (e.g, sodium carbonate) and optionally other detergent ingredients into a high speed mixer/densifier (residence time 5–30 seconds) so as to form particles containing a partially or totally neutralized anionic surfactant salt and the other starting detergent ingredients. Optionally, the contents in the high speed mixer/densifier can be sent to a moderate speed mixer/densifier (e.g. Lödige KM) for further mixing resulting in the finished high density detergent composition. See U.S. Pat. No. 5,164,108.

Optionally, high density detergent compositions can be produced by blending onventional spray-dried detergent granules with detergent agglomerates in various proportions (e.g, a 60:40 weight ratio of granules to agglomerates) produced by one or a combination of the processes discussed herein. Additional adjunct ingredients such as enzymes, perfumes, brighteners and the like can be sprayed or admixed with the agglomerates, granules or mixtures thereof produced by the processes discussed herein. For example, see U.S. Pat. No. 5,569,645.

EXAMPLES 4–6

Several detergent compositions made in accordance with the invention and specifically for top-loading washing machines are exemplified below . The base granule is prepared by a conventional spray drying process in which the starting ingredients are formed into a slurry and passed though a spray drying tower having a countercurrent stream of hot air (200–300° C.) resulting in the formation of porous granules. The admixed agglomerates are formed from two feed streams of detergent ingredients which are continuously fed, at a rate of 1400 kg/hr, into a Lödige CB-30 mixer/densifier, one of which comprises a surfactant paste containing surfactant and water and the other stream containing starting dry detergent material containing sodium carbonate and insoluble inorganic builder such as hybrid aluminosilicate or combinations thereof with zeolite. The rotational speed of the shaft in the Lödige CB-30 mixer/densifier is about 1400. The contents from the Lödige CB-30 mixer/densifier are continuously fed into a Lödige KM-600 mixer/densifier for further build-up agglomeration. The resulting detergent agglomerates are then fed to a fluid bed dryer and to a fluid bed cooler before being admixed with the spray dried granules. The remaining adjunct detergent ingredients are sprayed on or dry added to the blend of agglomerates and granules. Alternately the magnseiosilicate can be dry-added, in whole or in part, to the composition.

| | 4 | 5 | 6 |
|---|---|---|---|
| Base Granule | | | |
| Aluminosilicate | 18.0 | 0 | 17.0 |
| Sodium sulfate | 10.0 | 8.0 | 19.0 |
| Sodium polyacrylate polymer | 3.0 | 3.0 | 2.0 |
| PolyethyleneGlycol (MW = 4000) | 2.0 | 2.0 | 1.0 |
| $C_{12-13}$ linear alkylbenzene sulfonate, Na | 6.0 | 6.0 | 7.0 |
| $C_{14-16}$ secondary alkyl sulfate, Na | 3.0 | 3.0 | 3.0 |
| $C_{14-15}$ alkyl ethoxylated sulfate, Na | 3.0 | 3.0 | 9.0 |
| Sodium silicate | 1.0 | 1.0 | 2.0 |
| Brightener 24[6] | 0.3 | 0.3 | 0.3 |
| Sodium carbonate | 7.0 | 7.0 | 25.7 |
| DTPA[1] | 0.5 | 0.5 | — |
| Admixed Agglomerates | | | |
| $C_{14-15}$ alkyl sulfate, Na | 5.0 | 5.0 | — |
| $C_{12-13}$ linear alkylbenzene sulfonate, Na | 2.0 | 2.0 | — |
| Sodium Carbonate | 4.0 | 11.0 | — |
| PolyethyleneGlycol (MW = 4000) | 1.0 | 1.0 | — |
| Admix | | | |
| Hybrid aluminosilicate | — | 20.0 | 5.0 |
| $C_{12-15}$ alkyl ethoxylate (EO = 7) | 2.0 | 2.0 | 0.5 |
| Perfume | 0.3 | 0.3 | 1.0 |
| Polyvinylpyrrilidone | 0.5 | 0.5 | — |
| Polyvinylpyridine N-oxide | 0.5 | 0.5 | — |
| Polyvinylpyrrolidone-polyvinylimidazole 0.5 | | 0.5 | — |
| Distearylamine & Cumene sulfonic acid 2.0 | 2.0 | — | |
| Soil Release Polymer[2] | 0.5 | 0.5 | — |
| Lipolase Lipase (100.000 LU/I)[4] | 0.5 | 0.5 | — |
| Termamyl amylase (60 KNU/g)[5] | 0.3 | 0.3 | — |

-continued

| | 4 | 5 | 6 |
|---|---|---|---|
| CAREZYME ® (1000 CEVU/g)[4] | 0.3 | 0.3 | — |
| Protease (40 mg/g)[5] | 0.5 | 0.5 | 0.5 |
| NOBS[3] | 5.0 | 5.0 | — |
| Sodium Percarbonate | 12.0 | 12.0 | — |
| Polydimethylsiloxane | 0.3 | 0.3 | — |
| Miscellaneous (water, etc.) | balance | balance | balance |
| Total | 100 | 100 | 100 |

[1]Diethylene Triamine Pentaacetic Acid
[2]Made according to U.S. Pat. No. 5,415,807, issued May 16, 1995
[3]Nonanoyloxybenzenesulfonate
[4]Purchased from Novo Nordisk A/S
[5]Purchased from Genencor
[6]Purchased from Ciba-Geigy
Aluminosilicate = 1–10 A Zeolite A

What is claimed is:

1. A detergent composition comprising:

(a) from about 0.1% to about 99% of a builder system comprising, in part, a particulate inorganic ion-exchanging builder material, said builder material comprising a hybrid of crystalline zeolitic aluminosilicate and at least one occluded nonsilicate cobuilder; and (b) from about 0.1% to about 99% of detergent adjuncts.

2. A detergent composition according to claim 1 wherein said hybrid comprises from about 0.01 to 1.0 weight fraction of said builder system and said hybrid is characterized by a capacity to sequester calcium in excess of the amount of charge inducing aluminum in the zeolitic aluminosilicate.

3. A detergent composition according to claim 1 wherein said hybrid comprises from about 0.1 to 1.0 weight fraction of said builder system and said hybrid is characterized by a calcium ion exchange capacity of at least 15% greater than the calcium ion exchange capacity of a reference material selected from non-hybridized zeolite A.

4. A detergent composition according to claim 1 wherein said occluded nonsilicate cobuilder is selected from (i) the group consisting of occluded phosphate, occluded carbonate, occluded borate, occluded nitrate, occluded nitrite, occluded sulfite, occluded $Na_2O$ and mixtures thereof; and (ii) mixtures of said occluded nonsilicate cobuilder and occluded silicate; provided that in any of said mixtures of occluded nonsilicate cobuilder and occluded silicate, the weight fraction of occluded silicate is no more than about 0.99, preferably no more than about 0.80.

* * * * *